US010077598B2

(12) United States Patent
Albrecht

(10) Patent No.: US 10,077,598 B2
(45) Date of Patent: Sep. 18, 2018

(54) VERSATILE HYBRID WINDOW SYSTEM

(71) Applicant: Sierra Pacific Industries, Anderson, CA (US)

(72) Inventor: Scott D. Albrecht, Merrill, WI (US)

(73) Assignee: Sierra Pacific Industries, Anderson, CA (US)

( * ) Notice: Subject to any disclaimer, the term of this patent is extended or adjusted under 35 U.S.C. 154(b) by 0 days.

(21) Appl. No.: 15/248,529

(22) Filed: Aug. 26, 2016

(65) Prior Publication Data

US 2017/0058593 A1 Mar. 2, 2017

Related U.S. Application Data

(63) Continuation-in-part of application No. 14/838,798, filed on Aug. 28, 2015.

(60) Provisional application No. 62/211,531, filed on Aug. 28, 2015.

(51) Int. Cl.

| | |
|---|---|
| ***E06B 1/14*** | (2006.01) |
| ***E06B 7/14*** | (2006.01) |
| ***E06B 1/36*** | (2006.01) |
| ***E06B 1/60*** | (2006.01) |
| ***E06B 1/02*** | (2006.01) |
| ***E06B 3/30*** | (2006.01) |
| *E06B 1/70* | (2006.01) |
| *E06B 3/46* | (2006.01) |

(52) U.S. Cl.

CPC ..... *E06B 7/14* (2013.01); *E06B 1/02* (2013.01); *E06B 1/36* (2013.01); *E06B 1/60* (2013.01); *E06B 3/303* (2013.01); *E06B 1/702* (2013.01); *E06B 3/46* (2013.01)

(58) Field of Classification Search

CPC ..... E06B 7/14

See application file for complete search history.

(56) References Cited

U.S. PATENT DOCUMENTS

| | | | | |
|---|---|---|---|---|
| 4,240,765 | A | 12/1980 | Offterdinger | |
| 4,254,583 | A | 3/1981 | Smits et al. | |
| 4,328,644 | A | 5/1982 | Scott et al. | |
| 4,691,487 | A * | 9/1987 | Kessler | E06B 7/14 137/527.8 |
| 4,837,977 | A | 6/1989 | Mauro | |
| 5,123,212 | A * | 6/1992 | Dallaire | E06B 7/14 49/408 |
| 5,179,804 | A * | 1/1993 | Young | E06B 1/70 49/468 |

(Continued)

FOREIGN PATENT DOCUMENTS

CA 2 343 865 C 7/2006

*Primary Examiner* — Andrew J Triggs

(74) *Attorney, Agent, or Firm* — Merchant & Gould P.C.

(57) ABSTRACT

An extrusion for a multiple configuration window base frame is disclosed. In one aspect, the frame includes a main body defining an interior-side surface and an opposite opening-side surface extending between first and second ends. To facilitate use with different window types, part or all of the opening-side surface can be formed in a parallel arrangement with the interior-side surface. The frame can include a first attachment arrangement located proximate the main body first end that is configured for attachment to one or more cladding members. In one aspect, the first attachment arrangement includes a first clip member having a first outer portion and a first inner portion that define a first female receiving area and having a first overhang portion extending at least partially across the female receiving area to enable a snap-fit connection between the main body and the cladding member.

18 Claims, 38 Drawing Sheets

(56) References Cited

U.S. PATENT DOCUMENTS

| | | | | |
|---|---|---|---|---|
| 5,553,420 | A | 9/1996 | Klimek | |
| 6,044,611 | A | 4/2000 | Burnett | |
| 6,055,782 | A | 5/2000 | Morton et al. | |
| 6,321,494 | B1 | 11/2001 | Oberg | |
| 6,374,557 | B1 * | 4/2002 | O'Donnell | E06B 7/14 160/44 |
| 6,745,523 | B2 | 6/2004 | Petta | |
| 6,992,958 | B2 | 1/2006 | Kudo et al. | |
| 7,073,292 | B1 | 7/2006 | Minter et al. | |
| 7,150,130 | B2 | 12/2006 | Kobayashi et al. | |
| 7,669,369 | B2 * | 3/2010 | Henry | E06B 1/70 49/408 |
| 8,448,384 | B2 * | 5/2013 | Wernlund | E06B 1/70 49/471 |
| 8,561,365 | B2 | 10/2013 | Albrecht et al. | |
| 9,062,490 | B2 * | 6/2015 | Kadavy | E06B 7/16 |
| 2003/0079414 | A1 | 5/2003 | Rangabasyam et al. | |
| 2003/0126812 | A1 | 7/2003 | Folsom et al. | |
| 2004/0118050 | A1 | 6/2004 | Liu | |
| 2004/0211132 | A1 | 10/2004 | Petta et al. | |
| 2005/0016073 | A1 | 1/2005 | Petta et al. | |
| 2005/0183351 | A1 | 8/2005 | Brunnhofer | |
| 2006/0150521 | A1 * | 7/2006 | Henry | E06B 1/70 |
| 2007/0011948 | A1 | 1/2007 | Rangabasyam et al. | |
| 2007/0137119 | A1 | 6/2007 | Guillemette | |
| 2008/0196342 | A1 | 8/2008 | Franklin | |
| 2010/0300001 | A1 * | 12/2010 | Wernlund | E06B 1/70 |
| 2014/0260011 | A1 * | 9/2014 | Pettibone | E06B 7/14 52/209 |
| 2017/0058593 | A1 * | 3/2017 | Albrecht | E06B 7/14 |

* cited by examiner

VERSATILE HYBRID WINDOW SYSTEM

RELATED APPLICATIONS

This application claims priority to U.S. Provisional Patent Application Ser. No. 62/211,531, filed on Aug. 28, 2015. The entirety of U.S. 62/211,531 is incorporated by reference herein. To the extent appropriate, this application also claims priority to U.S. patent application Ser. No. 14/838,798, filed on Aug. 28, 2015, the entirety of which is also incorporated by reference herein.

TECHNICAL FIELD

This disclosure relates generally to window assemblies, and methods of constructing window assemblies.

BACKGROUND

Window assemblies have historically been fabricated with a structural base frame and a sash frame, in addition to various trim pieces. The base frame is the portion of the window assembly which is attached to the structure of the building. The sash frame is the portion of the window assembly which holds the window pane and fits within the base frame. In some windows, the sash frame is fixed to the frame such that the window cannot be opened. In other embodiments, such as a casement window or a double hung window, the sash frame is movable with respect to the base frame.

Many materials have been utilized to construct window assemblies, such as wood, polyvinyl chloride (PVC), fiberglass and aluminum. Each of these materials has various advantages and disadvantages with respect to the other, such as cost, durability, aesthetics and the ability to prevent air and moisture infiltration. Frequently, the structural and trim pieces of a window assembly are constructed of the same type of material. However, it is sometimes the case that a window assembly will be constructed by using two different materials. For example, interior wood trim pieces have been used in conjunction with a vinyl window assembly to improve the interior aesthetics of the window assembly. Another example is where aluminum or vinyl exterior cladding has been added to a wooden window assembly in order to improve the durability of the window assembly without sacrificing interior aesthetics. In the prior art, including the above cited examples, the components of differing materials in the window assembly are often connected to each other through the use of separate mechanical fasteners and/or sealants. Improvements in window assemblies which utilize more than one material are desired.

SUMMARY

An extrusion for a multiple configuration window base frame is disclosed. In one aspect, the frame includes a main body defining an interior-side surface and an opposite opening-side surface extending between first and second ends. The frame also includes a first attachment arrangement located proximate the main body first end that is configured for attachment to one or more cladding members. In one aspect, the first attachment arrangement includes a first clip member having a first outer portion and a first inner portion that define a first female receiving area and having a first overhang portion extending at least partially across the female receiving area to enable a snap-fit connection between the main body and the cladding member.

In one example, an extrusion for a multiple configuration window base frame includes a main body defining an interior-side surface and an opposite opening-side surface extending between first and second ends, wherein the interior-side surface is parallel to the opening-side surface. The main body can also include a first attachment arrangement located proximate the main body first end, the first attachment arrangement being configured for attachment to one or more cladding members, and can include a second attachment arrangement located proximate the main body second end, the second attachment arrangement being configured for attachment to one or more trim members, and can include a third attachment arrangement located at or between the first and second ends, the third attachment arrangement being configured for attachment to one or more interior members.

A window assembly is also disclosed that has a base frame assembly supporting at least one window pane and being configured for insertion into an opening in a wall, wherein the base frame assembly is formed from extruded segments defining a main body having an interior-side surface and an opposite opening-side surface extending between first and second ends, wherein the interior-side surface is parallel to the opening-side surface. The window assembly can also include an interior assembly attached to a first one of the extruded segments of the base frame assembly to form a sloped sill and a cladding member attached to the first extruded segment that defines a plurality of water drainage apertures. In one aspect, the base frame assembly, the interior assembly, and the cladding member defining an interior drainage path extending from the water drainage apertures to an interstitial space defined between the interior assembly and the base frame first extruded segment.

An extrusion for a multiple configuration window base frame is also disclosed. In one aspect, the frame includes a main body defining an interior-side surface and an opposite opening-side surface extending between first and second ends, wherein the main body opening-side surface is parallel to the interior-side surface proximate the first end to enable the main body to be assembled to form a base frame assembly for a double hung type window and for a casement type window. The main body can also include a first attachment arrangement located proximate the main body first end, the first attachment arrangement being configured for attachment to one or more cladding members, and can include a second attachment arrangement located proximate the main body second end, the second attachment arrangement being configured for attachment to one or more trim members, and can include a third attachment arrangement located at or between the first and second ends, the third attachment arrangement being configured for attachment to one or more interior members.

A method for constructing a window assembly is also disclosed. The method can include the steps of providing a plurality of extruded base frame members; assembling the plurality of extruded base frame members to form a base frame assembly; providing a first plurality of interior assembly components that, when assembled together, form an interior assembly frame for a double hung type window; providing a second plurality of interior assembly components that, when assembled together, form an interior assembly frame for a casement type window; and attaching either the first plurality of interior assembly components or the second plurality of interior assembly components to the base frame assembly.

DETAILED DESCRIPTION OF THE DRAWINGS

Reference will now be made in detail to exemplary aspects of the present disclosure that are illustrated in the accompanying drawings. Wherever possible, the same reference numbers will be used throughout the drawings to refer to the same or like parts.

As is further explained herein, the concepts presented herein allow for multiple window styles to be formed from a single base frame platform. For example, a common base frame assembly 110 can be utilized with various other attachable components to form a horizontal sliding window, a casement window, single or double hung windows, fixed windows, awning windows, and other types of windows.

Figure 1:
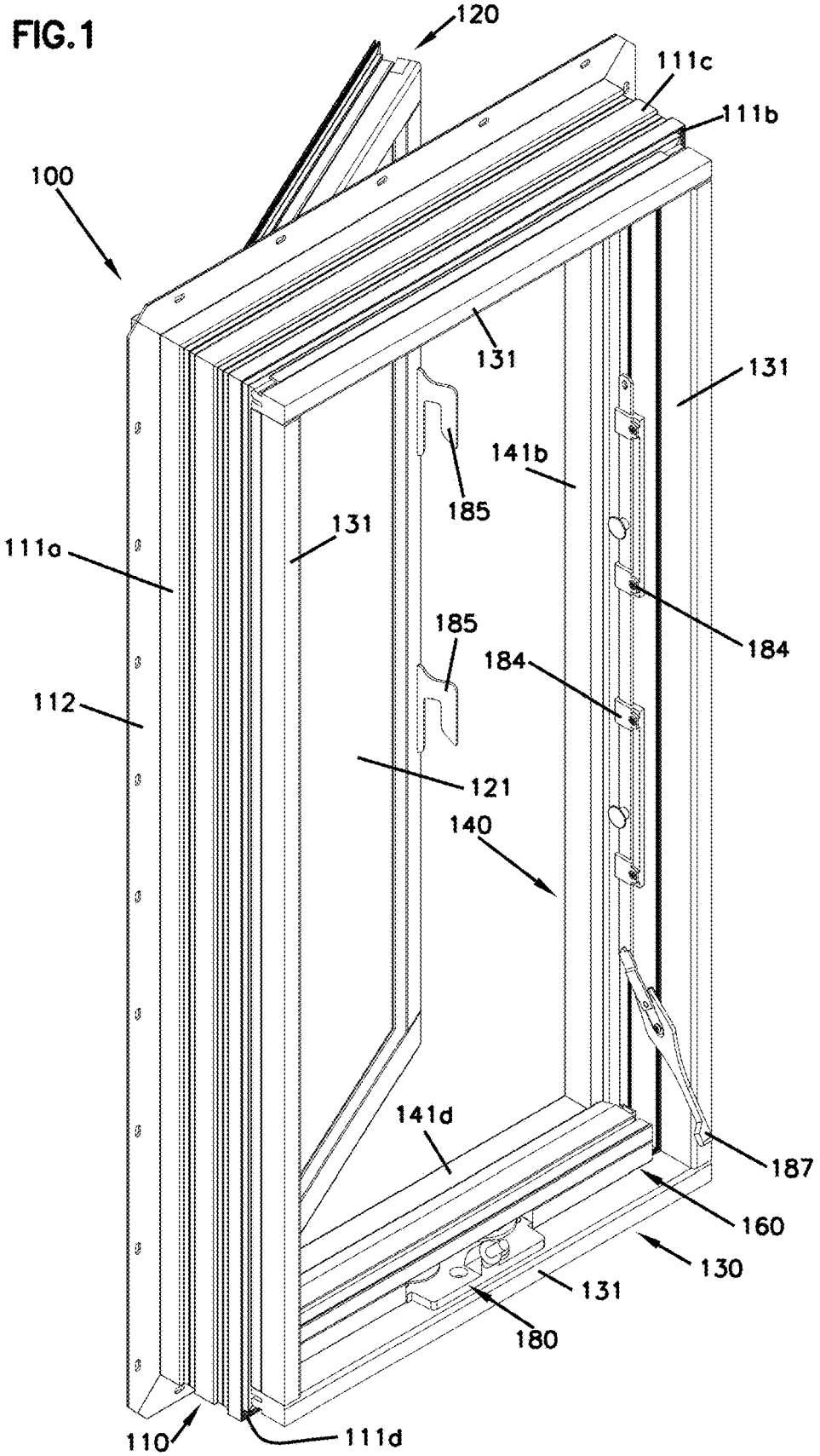
FIG. 1 is a perspective view from the interior side a casement style window assembly, with the sash frame assembly being in an open position.
Figure 2:
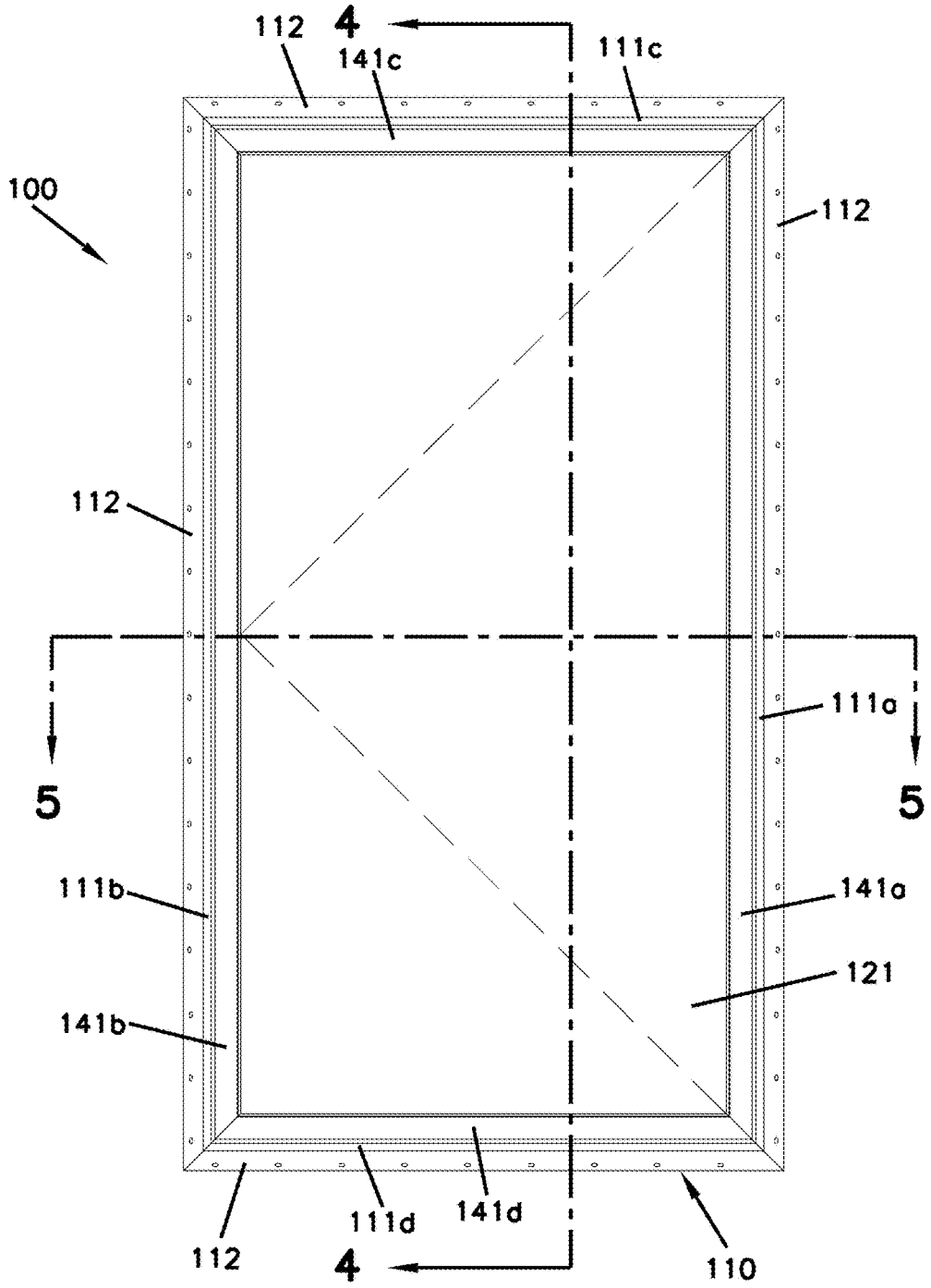
FIG. 2 is a front view of the exterior face of the window assembly of FIG. 1, with the sash frame assembly being in a closed position.

Referring to FIGS. 1 and 2, an exemplary embodiment of a window assembly 100 is shown. The window assembly 100 depicted is a casement style window and is only presented to illustrate the general components of window assemblies in generalized manner. Even though specific depictions of other styles of fully assembled window assemblies are not presented herein, one having ordinary skill in the art will readily understand from the cross-sectional views and descriptions presented herein how to form a fully formed window assembly of any style.

As mentioned above, one aspect of the disclosure is base frame assembly 110. Base frame assembly 110 is the portion of window assembly 100 that is directly connected to the wall surrounding the opening of a building or other structure. Additionally, base frame assembly 110 is for providing the primary structural support for window assembly 100 and for providing a platform to which the other components of window assembly 100 can be mounted. As shown in FIGS. 1-2, base frame assembly 110 defines a frame having the shape of a rectangle or square from four base frame members, 111*a*, 111*b*, 111*c*, 111*d*. Other shapes are possible. Each of the four base frame members 111*a*, 111*b*, 111*c*, 111*d* is cut from base frame member stock 111. Because each base frame member 111*a*, 111*b*, 111*c*, 111*d* is formed from the same base frame member stock 111, they all have the same cross-sectional profile. Further, base frame member stock 111 can be produced in lineal fashion such that many base frame members can be cut from a single length of stock. Thus, the use of a single lineal profile results in a reduction of frame part types, part machining and assembly time. In the exemplary embodiment shown, base frame member stock 111 is a multi-channeled extrusion of vinyl which has desirable insulating and structural properties. Base frame member stock 111 may be constructed from other extrudeable, pultrudeable or roll formed materials as well, including but not limited to aluminum, steel alloys, polyolefin polymers, cellular PVC (polyvinyl chloride or vinyl) polymers, cellulosic plastic composites, fiberglass composites, polymeric alloys or other extrudeable, pultrudeable and formable material.

To form base frame assembly 110, each base frame member 111*a*, 111*b*, 111*c*, 111*d* is first cut from base member stock 111 to the desired length, with 45 degree corner cuts at each end. Subsequently, the members are joined together to form base frame assembly 110. Where base frame member stock 111 is constructed from vinyl, or any other weldable material, base frame members 111*a*, 111*b*, 111*c* and 111*d* may be joined together by welding to form a welded seam and a water and air tight assembly. The use of chemical bonding and mechanical attachment methods may also be utilized. Once assembled, base members 111*a* and 111*b* form the side jambs for window assembly 100 while 111*c* and 111*d* form the head and sill jambs, respectively. As will be discussed below in further detail below, FIGS. 4, 5, and 6 respectively show frame member stock embodiments 113, 115, and 117.

Figure 7:
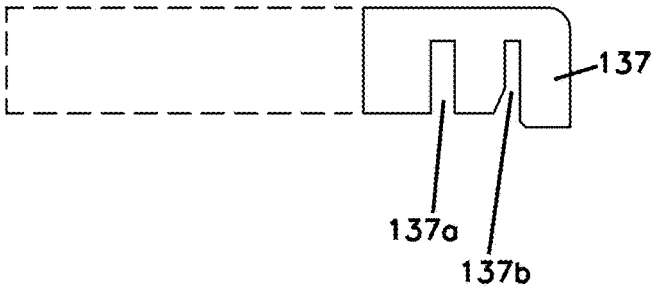
FIG. 7 is a cross-sectional view of a first trim piece suitable for attachment to the base frame members of FIG. 4-6 at a first attachment arrangement of the base frame members.
Figure 8:
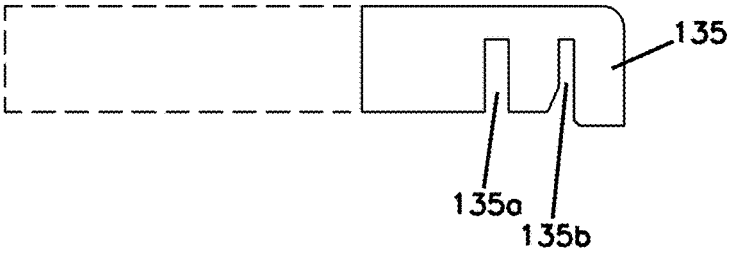
FIG. 8 is a cross-sectional view of a second trim piece suitable for attachment to the base frame members of FIG. 4-6 at a first attachment arrangement of the base frame members.
Figure 9:
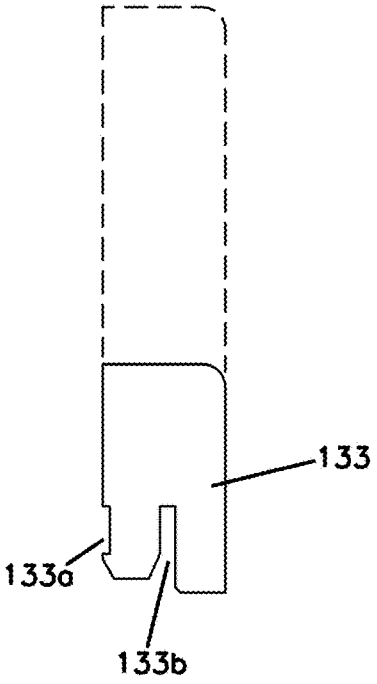
FIG. 9 is a cross-sectional view of a third trim piece suitable for attachment to the base frame members of FIG. 4-6 at a first attachment arrangement of the base frame members.

Another aspect of the disclosure is the interior trim assembly 130 which is formed from individual trim pieces 131. In some embodiments, the trim pieces act as jamb extenders for extending the effective width of each side of the window assembly 100 such that it will match the width of the rough opening into which it is placed. As the position of window assembly 100 in the rough opening is determined by nail fin 112 or other exterior-side components of the window, a jamb extender, 131 can be required to bring the interior side of window assembly 100 flush with the interior wall. A wide variety of trim pieces is possible for use with the frame members 113, 115, 117. For example, and as will be discussed below in further detail, FIGS. 7, 8, and 9 respectively show trim piece member embodiments 137, 135, and 133.

Another aspect of the disclosure is exterior cladding assembly 140 which is for providing a durable and aesthetically pleasing exterior surface for window assembly 100. As shown in FIGS. 1-2, exterior cladding assembly 140 defines a frame in the shape of a rectangle or square from four exterior cladding members, 141*a*, 141*b*, 141*c*, 141*d*. Other shapes are possible. Each of the exterior cladding members 141*a*, 141*b*, 141*c*, 141*d* is cut from exterior cladding stock 141. Because each exterior cladding member 141*a*, 141*b*, 141*c*, 141*d* is formed from the same exterior cladding stock 141, they all have the same cross-sectional profile. Further, exterior cladding stock 141 can be produced in lineal fashion such that many exterior cladding members can be cut from a single length of stock. Thus, the use of a single lineal profile results in a reduction of frame part types, part machining and assembly time. In the exemplary embodiment shown, exterior cladding stock 141 is a painted aluminum extrusion. Exterior cladding stock 141 may be constructed from other extrudeable, pultrudeable or roll formed materials as well, including but not limited to steel alloys, polyolefin polymers, cellular PVC (polyvinyl chloride or vinyl) polymers, cellulosic plastic composites, fiberglass composites, polymeric alloys or other extrudeable, pultrudeable and formable material. A wide variety of cladding member embodiments is possible for use with the frame members 113, 115, 117. For example, and as will be discussed below in further detail, FIGS. 10 to 18 respectively show alternative cladding member embodiments 142 to 148.

Yet another aspect of the disclosure is the use of an interior assembly 150 which can include various stop and trim assemblies that can work in conjunction with trim assembly 140. The interior assembly components 150 can be assembled together to form an interior frame. Each of these assemblies is for providing an aesthetically pleasing surface to the interior surfaces of window assembly 100, and to conceal certain mechanical components of the window, for example, the counterbalance weights and the operator mechanism 180. In a casement style window, the interior assembly can form a head stop, sill stop and side stop assemblies which collectively provide a stop for a sash assembly 120 to close against. However, it should be understood that the number and type of interior trim assembly components used can be varied without departing from the concepts presented herein for other types of windows, as explained herein. A wide variety of interior assembly arrangements is possible for use with the frame members 113, 115, 117. For example, and as will be discussed below in further detail, FIGS. 19 to 26 respectively show alternative interior assembly arrangements 151 to 159.

With continued reference to FIGS. 1 and 2, another aspect of window assembly 100 is sash assembly 120. Sash assembly 120 is for securing a window pane 121 and for providing a moveable assembly such that the window assembly 100 can be opened to the outdoors, where desired. In the exemplary embodiment shown, sash assembly 120 includes an interior sash assembly 122 which snap-fits onto an exterior sash assembly 125 thereby securing window pane 121. Interior and exterior sash assemblies 122, 125 may be made from the same or different materials. One having skill in the art will understand that sash assembly 120 can be configured differently for different styles of windows without departing from the concepts presented herein.

Yet another aspect of the disclosure is window operator mechanism 180. Window operator mechanism 180 is for allowing a user to open and close window assembly 100 by rotating an operator arm (not shown). Window operator mechanism 180 is also for locking window assembly 100 in a locked position. In the embodiment shown, operator mechanism 180 includes operator 181, hinges 182, operator arm track 183, sash lock tie bar mechanism 184, sash lock keeper 185, sash snubber 186 and lock operator 187. As shown, each of the aforementioned components is attached through the use of screws. Together, these components allow a user to open and close window assembly 100 through the manipulation of operator 180. Further, by manipulating lock operator 187, the window assembly can be placed in a locked position whereby sash lock tie bar mechanism 184 engages sash lock keepers 185. One having skill in the art will understand that other types of operators and lock mechanisms can be provided and configured for use with different styles of windows without departing from the concepts presented herein.

Figure 3:
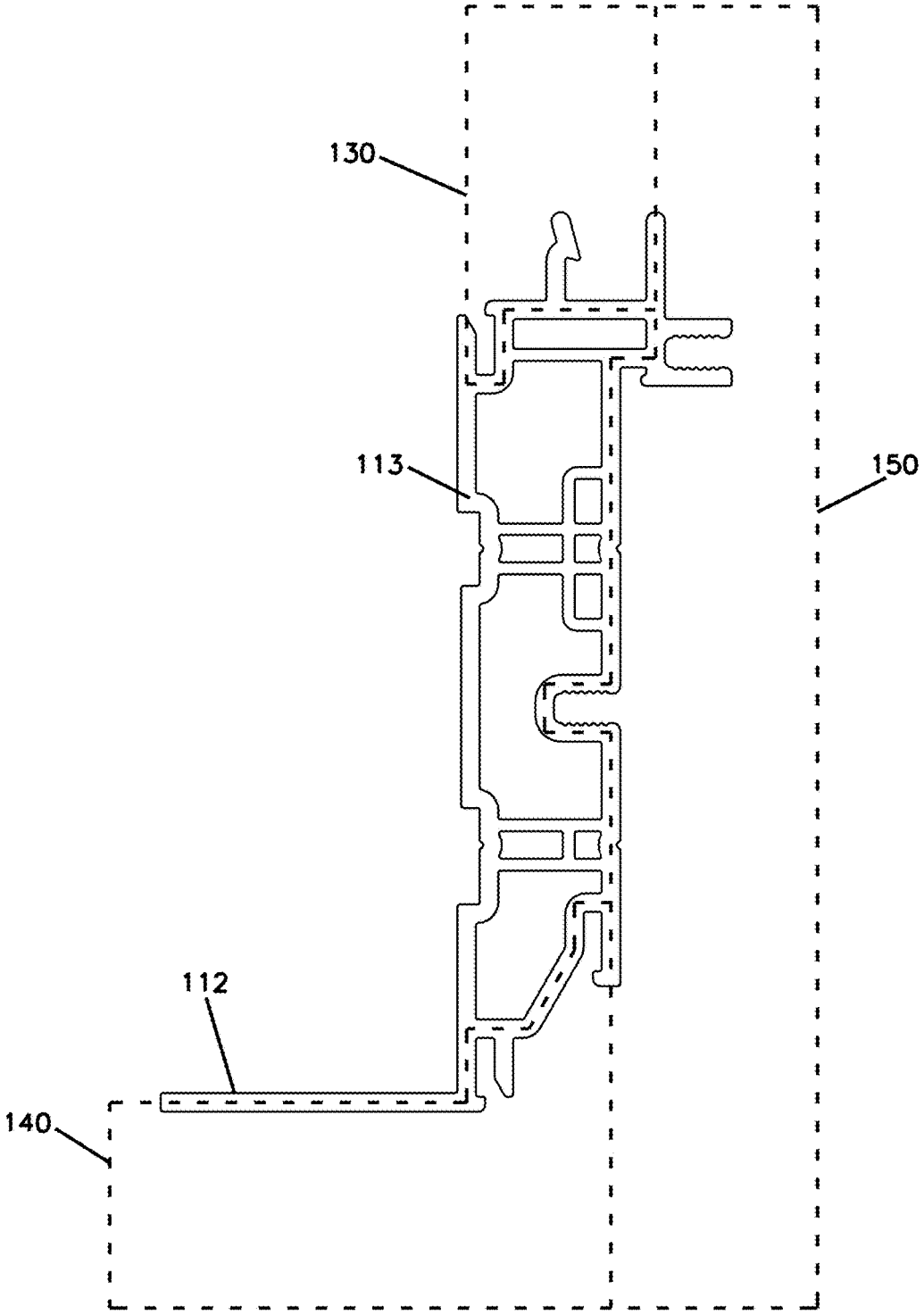
FIG. 3 is a cross-sectional view of a base frame member usable to form multiple styles of window assemblies, for example, casement window assemblies of the type shown in FIG. 1, and double hung and horizontal sliding window assemblies, wherein multiple attachment zones are shown.
Figure 4:
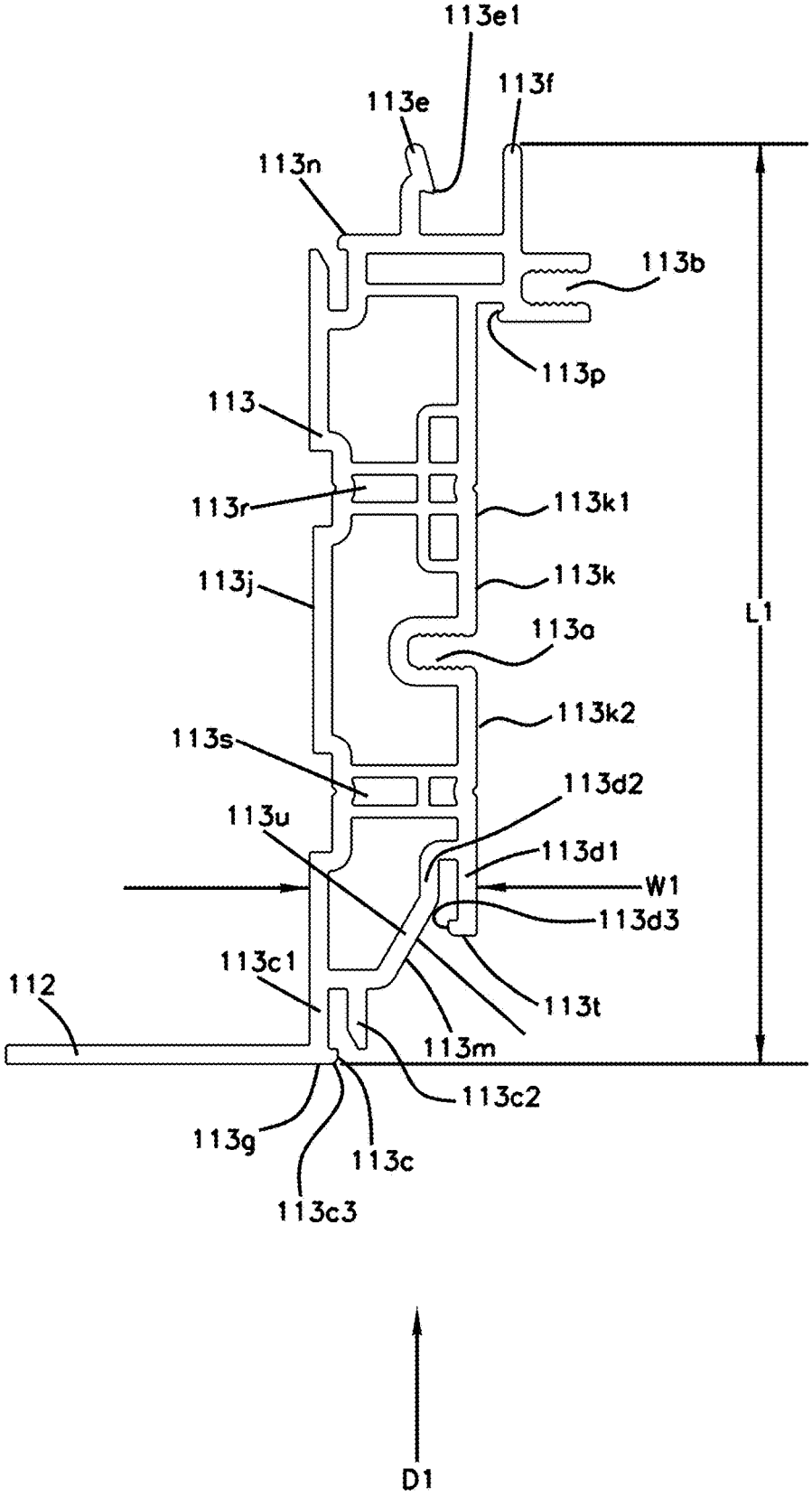
FIG. 4 is a cross-sectional view of the base frame member of FIG. 3 without the attachment zones shown.
Figure 5:
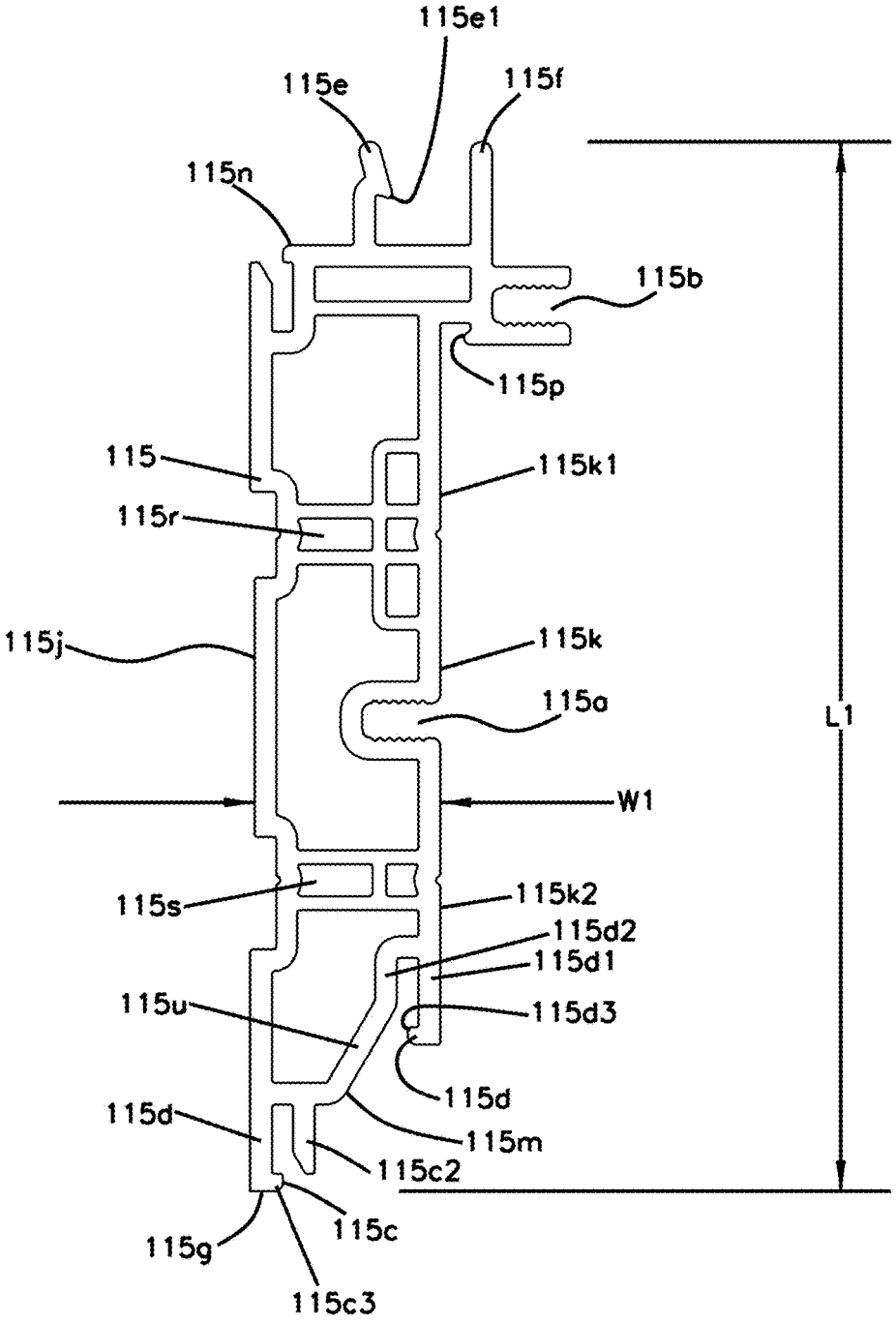
FIG. 5 is a cross-sectional view of a second embodiment of a base frame member similar to that shown in FIG. 3, but without a nail fin.

As mentioned previously, the base frame members all have the same cross-sectional area because they are all cut from base frame member stock 111. For ease of reference, the section shown in FIGS. 3 and 4 will be referred to as base frame member 113, although it should be appreciated that all of the identified features of FIGS. 3 and 4 apply equally to each of base frame members 111*a*, 111*b*, 111*c* and 111*d*. In the exemplary embodiment shown at FIG. 3, it can be seen that the base frame member 113 is configured to connect to a trim piece or assembly 130, an exterior cladding piece or assembly 140, and an interior piece or assembly 150. The embodiments of FIGS. 4 and 5 are configured to accept these same components. As mentioned previously, the base frame members 113, 115, 117 are configured such that multiple styles of windows can be formed from the same base frame member profile and such that all four sides of the window assembly base frame can be formed from the same profile.

With reference to FIG. 4, it can be seen that the base frame member 113 includes a nail fin 112, an attachment arrangement including kerfs 113*a*, 113*b* and recess 113*p* for connection to any of the interior assembly arrangements 151 to 159, an attachment arrangement including snap-fit clips or members 113*c*, 113*d* for connection to any of the exterior cladding members 142 to 148, and an attachment arrangement including snap-fit clips or members 113*e*, 113*f* for connection to any of the trim pieces 133 to 137. The base frame member 113 is also shown as having an opening-side surface 113*j* and a parallel interior-side surface 113*k* extending between ends 113*m*, 113*n* and being separated by a width W1. The interior-side surface 113*k* is shown as having a first segment 113*k*1 and a second segment 113*k*2 that is coplanar with the first segment 113*k*1. As shown, each of the segments 113*k*1, 113*k*2 is perpendicular to the sash assembly 120 and window pane 121. Because the first segment 113*k*1 lies within the same plane as second segment 113*k*2, sightlines of the resulting window frame are minimized while also allowing for the same base frame member to be used in multiple types of windows, for example, in a double hung type window and in a casement type window, with or without additional attachments.

It is noted that the width W1 is constant on each side of the kerf 113*a*, wherein the majority of the length of the base frame member 113 is provided with the width W1. In one embodiment, width W1 is about ⅝ inch while in another embodiment, width W1 is about ¾ inch. This low profile design is narrow enough to allow the base frame members 113, 115, 117 to be built up with various interior assembly arrangements to create a jamb, header, and/or sill for any number of window types. Accordingly, a benefit to the disclosed design is that a single piece of manufacturing equipment can be placed in a single configuration to form a base frame usable in a wide variety of applications. Typically, multiple machines and configurations are required to produce such a wide array of products. The base frame members 113, 115, 117 are also provided with a length L1. In one example, L1 is four inches. In one example, L1 is less than four inches. A configuration in which L1 is four inches or less is advantageous in that standard equipment, which is often limited to working with a maximum four inch wide product, can be used to form the base frame members 113, 115, 117. Another advantage of the disclosed configuration is that two frames can be processed simultaneously on standard equipment. The embodiments shown in FIGS. 5 and 6 also include these same general features and are numbered likewise.

Each of the base frame members 113, 115, 117 is also shown as being provided with support structures 113*r*, 113*s*/115*r*, 115*s*/117*r*, 117*s* which include parallel webs extending between surfaces 113*k*, 113*j*/115*k*, 115*j*/117*k*, 115*j* and orthogonal webs extending between the parallel walls. The support structures 113*r*, 113*s*/115*r*, 115*s*/117*r*, 117*s* greatly enhance the structural rigidity of the base frame members 113, 115, 117 and thus allow for larger window sizes to be formed. For example, base frame members 113, 115, 117 can be used to build window sizes of up to 120 inches by 96 inches. The support structures 113*r*, 113*s*/115*r*,

115*s*/117*r*, 117*s* also function as crush zones for fasteners that are used to attached the base frame members 113, 115, 117 to the building structure such that the fasteners do not simply pass all of the way through the frame members 113, 115, 117 to the surface 113*j*, 115*j*, 117*j*.

Figure 6:
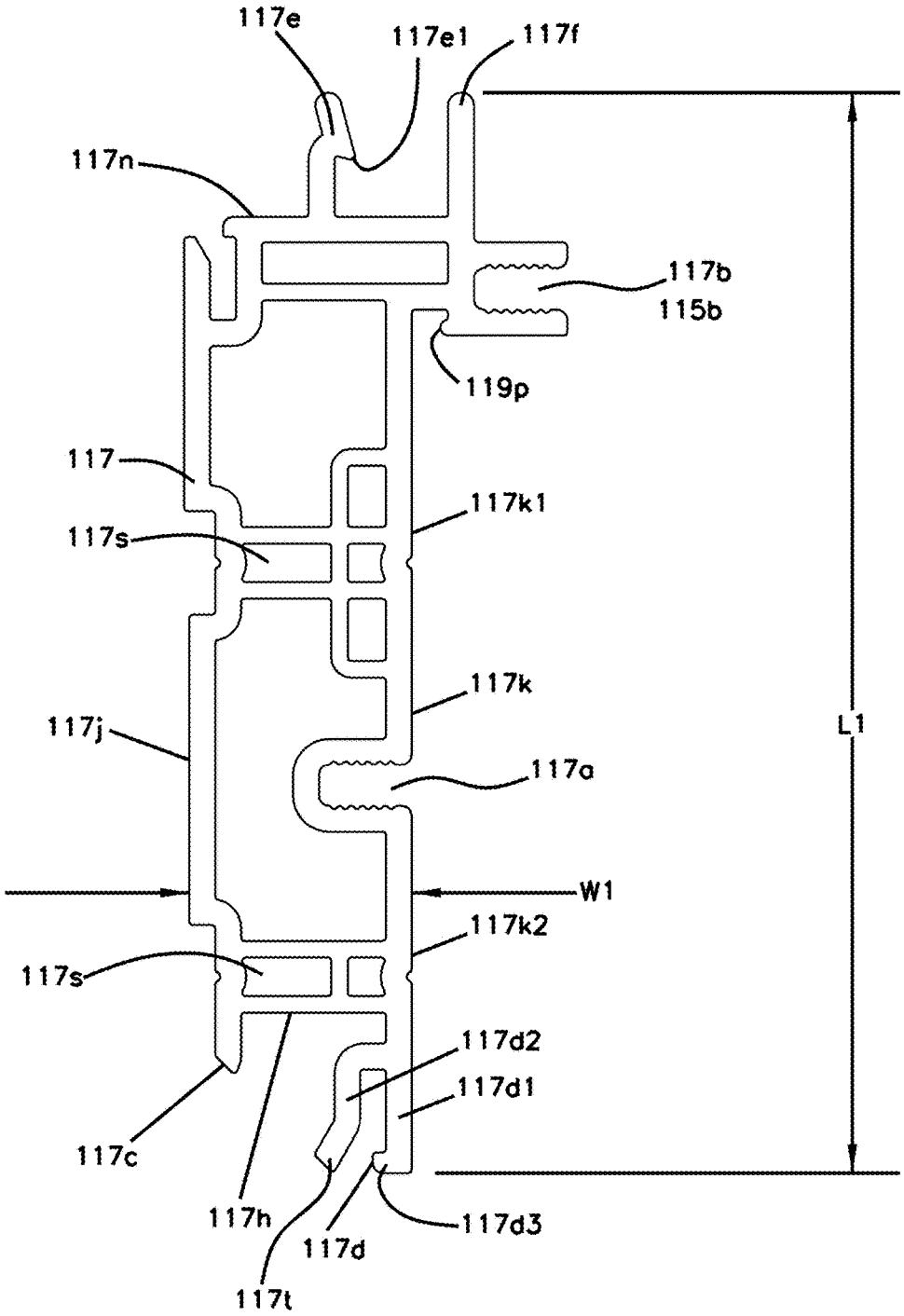
FIG. 6 is a cross-sectional view of a third embodiment of a base frame member similar to that shown in FIG. 3, configured for insert and pocket style window assemblies.

With specific regard to the embodiments shown at FIGS. 4 and 5, it is noted that the clips 113*c*/113*d*, 115*c*/115*d* form an inwardly directed female connection point configured to receive corresponding male outwardly directed clips of the cladding members 142 to 148 in a snap-fit arrangement. By "snap-fit" it is meant that a connection of the components can be achieved by simply pressing the components together until a clip snaps into a corresponding recess. This configuration is similar for the embodiments shown at FIGS. 5 and 6, although the embodiment at FIG. 6 is provided with only one clip.

As shown, the base clip 113*c*, 115*c* is formed by an outer portion 113*c*1, 115*c*1 and an inner portion 113*c*2, 115*c*2 to form a female reception area for receiving a clip portion 142*c*2, 143*c*2, 146*c*2, 147*c*2, 148*c*2 of an extension member 142*c*, 143*c*, 146*c*, 147*c*, 148*c* of the cladding member 142, 143, 146, 147, 148. The base clip 113*c*, 115*c* is also provided with an overhang portion 113*c*3, 115*c*3 that extends towards the surface 113*k*, 115*k* and across the reception area. The overhang portion 113*c*3, 115*c*3 enables for the snap-fit connection between the base frame member 113, 115 and the cladding member 142, 143, 146, 147, 148. As configured, the overhang portion 113*c*3, 115*c*3 is received by a corresponding recess portion 142*c*1, 143 *c*1, 146 *c*1, 147 *c*1, 148 *c*1 in the cladding members 142, 143, 146, 147, 148 and locked in place by a ramped portion 142*c*3, 143*c*3, 146*c*3, 147*c*3, 148*c*3. The ramped portion 142*c*3, 143*c*3, 146*c*3, 147*c*3, 148*c*3 functions to guide and deflect the clip portion 142*c*2, 143*c*2, 146*c*2, 147*c*2, 148*c*2 over the overhang portion 113*c*3, 115*c*3 until the overhang portion snaps into the recess portion 142*c*1, 143*c*1, 146*c*1, 147*c*1, 148*c*1.

The base clip 113*d*, 115*d* is configured similarly to the base clip 113*c*, 115*c*. As shown, the base clip 113*d*, 115*d* is formed by an outer portion 113*d*1, 115*d*1 and an inner portion 113*d*2, 115*d*2 to form a female reception area for receiving a clip portion 142*d*2, 143*d*2, 146*d*2, 147*d*2, 148*d*2 of an extension member 142*d*, 143*d*, 146*d*, 147*d*, 148*d* of the cladding member 142, 143, 146, 147, 148. The base clip 113*d*, 115*d* is also provided with an overhang portion 113*d*3, 115*d*3 that extends towards the surface 113*j*, 115*j* and across the reception area. The overhang portion 113*d*3, 115*d*3 enables for the snap-fit connection between the base frame member 113, 115 and the cladding member 142, 143, 146, 147, 148. As configured, the overhang portion 113*d*3, 115*d*3 is received by a corresponding recess portion 142*d*1, 143*d*1, 146*d*1, 147*d*1, 148*d*1 in the cladding members 142, 143, 146, 147, 148 and locked in place by a ramped portion 142*d*3, 143*d*3, 146*d*3, 147*d*3, 148*d*3. The ramped portion 142*d*3, 143*d*3, 146*d*3, 147*d*3, 148*d*3 functions to guide and deflect the clip portion 142*d*2, 143*d*2, 146*d*2, 147*d*2, 148*d*2 over the overhang portion 113*d*3, 115*d*3 until the overhang portion snaps into the recess portion 142*d*1, 143*d*1, 146*d*1, 147*d*1, 148*d*1.

To provide for further guidance of the clip portion 142*d*2, 143*d*2, 146*d*2, 147*d*2, 148*d*2 as the cladding member 142, 143, 146, 147, 148 is being inserted onto the base frame member 113, 115, a ramped portion 113*u*, 115*u* is provided that extends between the inner portions 113*c*2, 113*d*2 and 115*c*2, 113*d*2 at an oblique angle to the insertion direction D1 of the cladding member 142, 143, 146, 147, 148. The insertion direction D1 is essentially parallel to the surfaces 113*k*, 113*j*, 115*k*, 115*j* and to the portions 113*d*1, 113*d*2, 113*c*1, 113*c*2, 115*d*1, 115*d*2, 115*c*1, 115*c*2. During insertion, the end of the clip member 142*d*, 143*d*2, 146*d*2, 147*d*2, 148*d*2 will contact the ramped portion 113*u*, 115*u*. Because the ramped portion is disposed at an oblique angle to the insertion direction D1, the clip member 142*d*, 143*d*2, 146*d*2, 147*d*2, 148*d*2 will deflect and slide towards the female reception area of the base clip 113*d*, 115*d* until the snap-fit connection is achieved. As shown, the ramped portion 113*u*, 115*u* integrally formed with the inner portion 113*d*2, 115*d*2 and allows for the clip member 142*d*, 143*d*2, 146*d*2, 147*d*2, 148*d*2 to slide continuously into the female reception area of the base clip 113*d*, 115*d*.

Once the cladding member 142, 143, 146, 147, 148 is secured to the base member 113, 115, as can be seen at FIGS. 29 to 39, the resulting assembly is highly resistant to lateral forces (i.e. forces orthogonal to the insertion direction D1). This resistance is primarily due to the condition that at least one of the inner portions 113*c*2, 115*c*2 and 113*d*2, 115*d*2 of the base frame members 113, 115 will lock against the clip portions (e.g. 142*c*, 142*d*, etc.) when a lateral force is placed on the cladding members in one direction and the other of the inner portions 113*c*2, 115*c*2 and 113*d*2, 115*d*2 of the base frame members 113, 115 will lock against the clip portions (e.g. 142*c*, 142*d*, etc.) in the opposite direction. The outer portions 113*c*1, 115*c*1 and 113*d*2, 115*d*2 similarly lock against the clip portions (e.g. 142*c*, 142*d*, etc.) such that each clip portion (e.g. 142*c*, 142*d*, etc.) is locked and prevented from popping out of place by at least one of the inner and outer portions of the base frame member 113, 115. This configuration is an improvement over prior art attachment systems that have a cladding member with male clip portions that extend over the outside of the base frame members. One such configuration is shown in U.S. Pat. No. 8,561,365, wherein the clip members of the cladding members are only secured on the interior side to the base frame member, and can thus more easily snap out of the snap-fit type connection under a lateral load. Although only provided with a female clip portion 117*d*, the base frame member 117 shown in FIG. 6 functions in a similar way as the clip portions 113*d* and 115*d* and thus also operates to provide increased lateral load resistance over prior art configuration of the type disclosed in U.S. Pat. No. 8,561,365.

With reference to the embodiment shown at FIG. 4, a nail fin 112 is shown that is for providing structural support, and serves as a means for attaching window assembly 100 into a building window rough opening. As shown, nail fin 112 is integral to base frame member 113, however, nail fin 112 could be a separate component that is attached to base frame member 113 through the use of a multi-purpose kerf 113 or could be provided as part of one of the cladding members as is shown for some embodiments.

Multipurpose kerfs 113*a*, 113*b* are recesses within base member 113 and are used for the attachment of a variety of window assembly components having corresponding extensions for insertion into the kerfs 113. Examples of components that may be inserted into kerfs 113 are weather stripping, attachment clips and support blocks. These and other components are discussed in more detail later in the specification. Once the extensions are inserted into any of the multipurpose kerfs 113*a*, 113*b*, the component is securely attached to base frame member 113. To improve the degree to which the component is secured, kerfs 113 may be constructed to have inward protrusions to further engage the extensions of the components. Alternatively, the extensions may be barbed. Inserts can also be used within the kerfs. As shown in the figures, both inward kerf protrusions and barbed component extensions are used to ensure a secure connection. It should also be noted that the component extensions generally run the entire length of the kerf 113 to which it is attached. However, where practical, the component extensions could be constructed to engage the kerfs 113 at selected intervals. Other attachment means instead of kerfs may also be utilized.

Jamb extender clips 113*e*, 113*f* are integral to base frame member 113, but could be formed as a separate attachment through the use of kerfs, adhesives or mechanical fasteners. As shown, jamb extender clips 113*e*, 113*f* extend from base frame member 113 and have one inwardly extending protrusion 113*e*1. To connect the trim piece 131/133/135 to base frame member 113, all that is required is to press a jamb extender or trim piece 133/135/137 such that recesses 133*a*/135*a*/137*a* and 133*b*/135*b*/137*b* (See FIGS. 7 to 9) are aligned with clips 113*e*, 113*f*. In the particular embodiment shown, as trim piece 133/135/137 is fully pressed towards base frame member 113, clip 113*f* inserts into recess 133*b*/135*b*/137*b* while clip 113*e* clips into recess 133*a*/135*a*/137*a*, thereby creating a compressive force against trim piece 133/135/137. Such a construction ensures a secure connection between base frame member 113 and trim piece 133/135/137 without the need for adhesives or mechanical fasters. It should also be appreciated that a different combination of protrusions and recesses may be used without departing from the concepts disclosed herein.

From the foregoing disclosure, it should be appreciated that window assembly 100, 200 can be constructed from different types of materials whereby the advantages of each type of material is utilized to provide a high quality, yet economic window. In general terms, window assembly can be made from three types of materials. The first type is a wood type material which includes all varieties of wood and products created from wood products, for example hardwoods. The second type is a metal type material which includes all metals and materials having a metal content, for example aluminum and aluminum alloys. The third type of material is any material which does not fall within the first two material types and is characterized as a "non-wood/non-metal" material. This type would include vinyl, for example.

In more specific terms, window assembly 100 can be constructed such that base frame assembly 113/115/117 is formed from vinyl, which is structurally adequate, watertight and economical. Additionally, the exterior components, such as exterior cladding assembly 140 and the exterior of the sash assembly 120, can be constructed from durable painted aluminum which provides the appearance of an aluminum window from the exterior. Some of the components of the interior assembly 150, trim assembly 130, and the interior of sash assembly 120, can be constructed of wood such that the window, when viewed from the inside has the appearance of an all wood window. Thus, the foregoing disclosure allows for an assembled window to be constructed having a non-wood/non-metal vinyl structural frame, a metal aluminum exterior surface and a wood interior surface. Such a window assembly is not only economical, but also highly resistant to moisture and air infiltration and has good thermal insulation properties.

In addition to having lower material costs, the snap fit nature of the exterior cladding assembly 140; trim assembly 130; and the push-fit nature of the interior assembly 150 further reduce manufacturing costs and production times. Further, the fact that exterior cladding assembly 140, base frame assembly 110 and exterior sash assembly can be formed form lineal stock having a uniform cross-section further reduces capital requirements and manufacturing costs.

As noted above, FIGS. 10 to 18 show various embodiments of the exterior cladding members 140 that are usable with the base frame member 113, 115, and/or 117.

Figure 10:
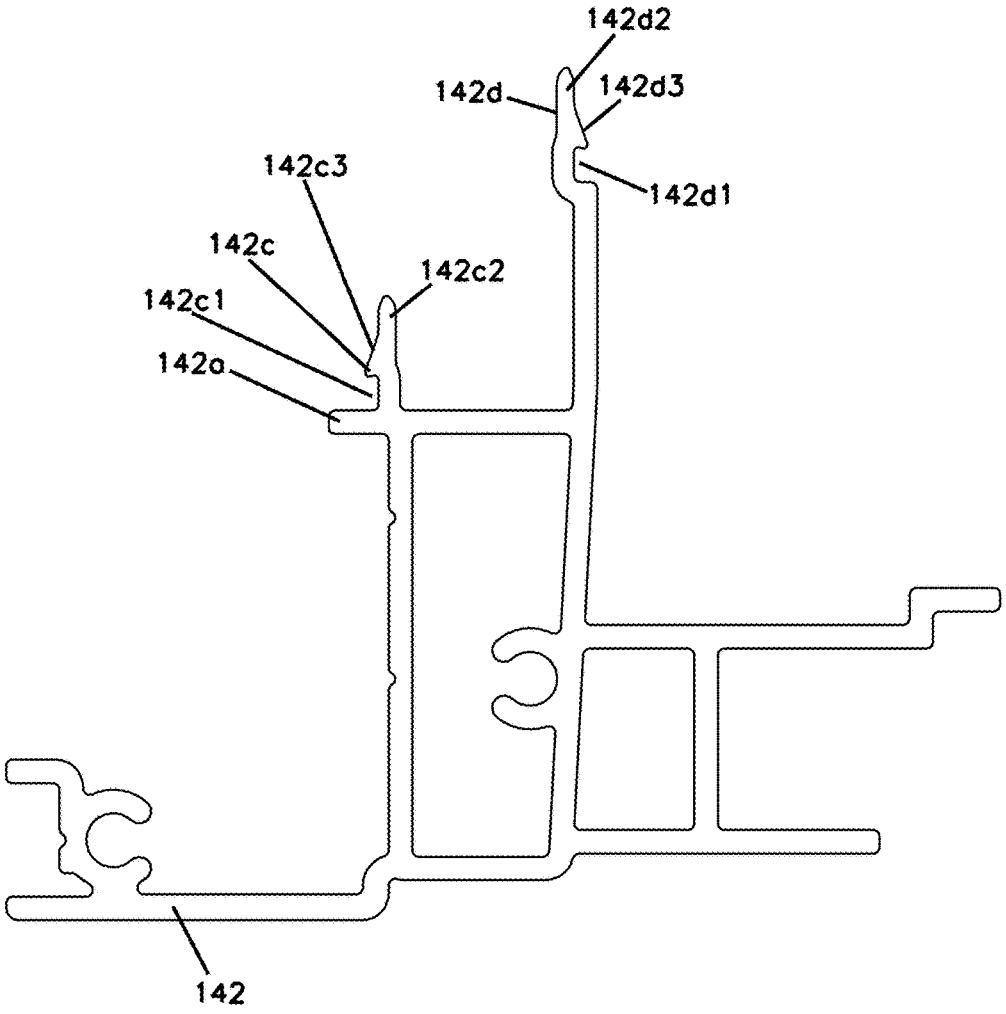
FIG. 10 is a cross-sectional view of a first exterior cladding piece suitable for attachment to the base frame members of FIG. 4-6 at a second attachment arrangement of the base frame members.

FIG. 10 shows a cladding member 142 which can be utilized in conjunction with a base frame member to form a jamb for a slider or double hung window.

Figure 11:
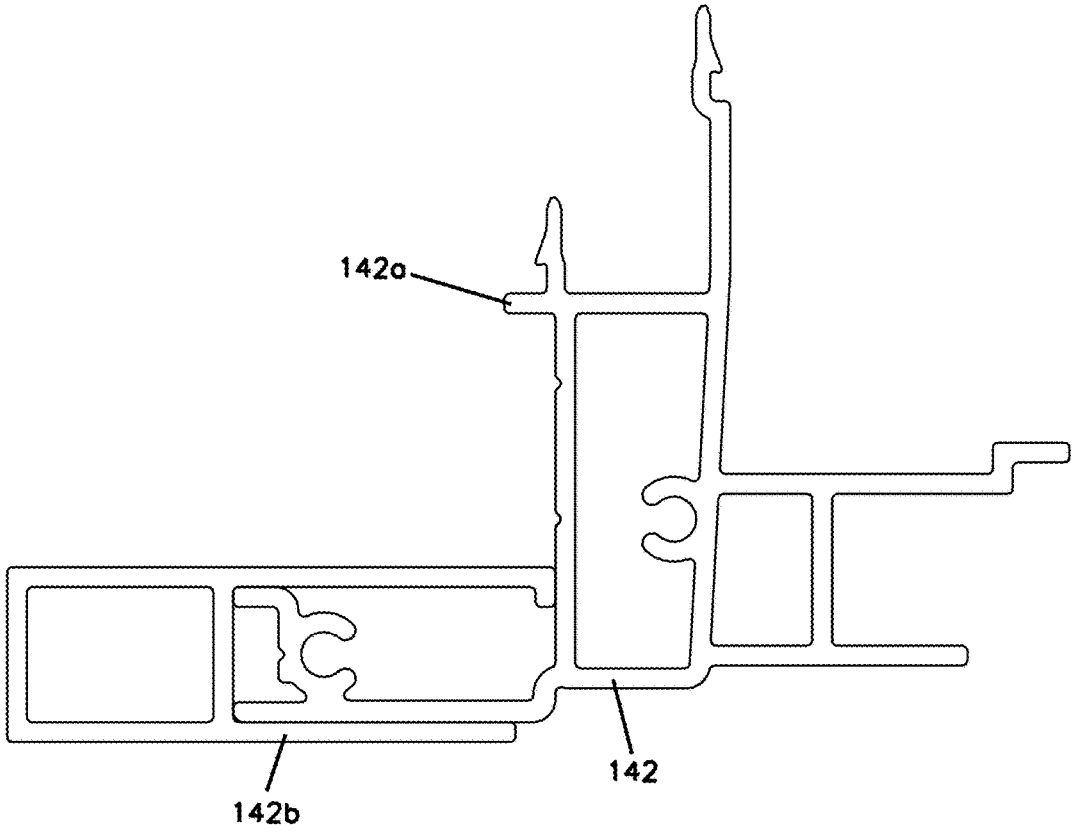
FIG. 11 is a cross-sectional view of the first exterior cladding piece of FIG. 10 with an adjustable extension piece for a flush fin type installation, with the extension piece being in a fully contracted position.
Figure 12:
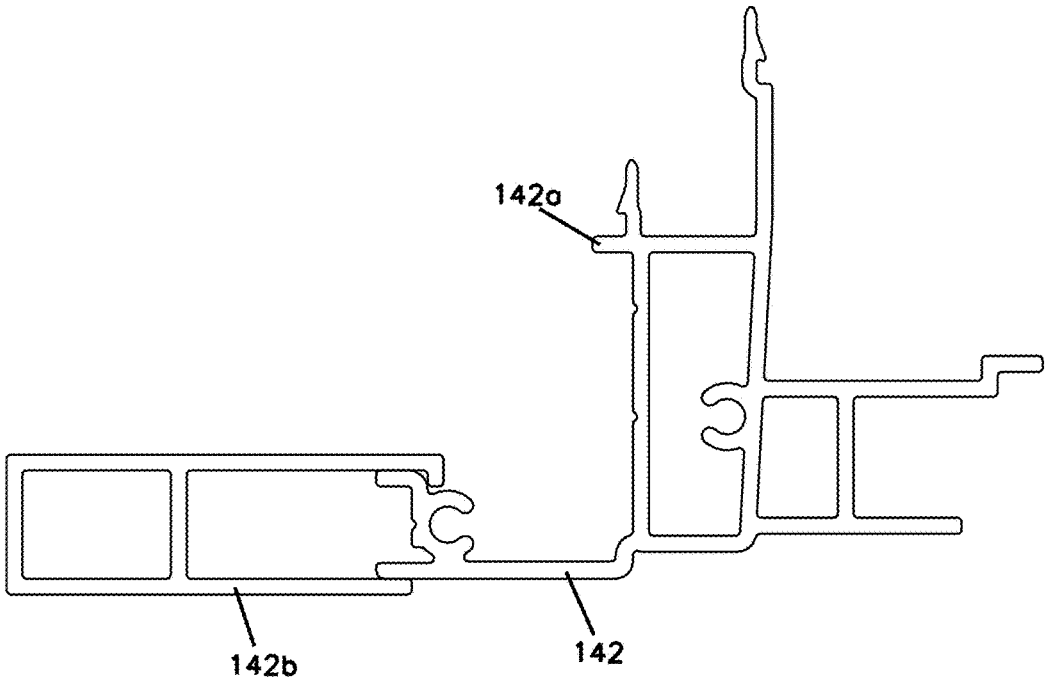
FIG. 12 is a cross-sectional view of the first exterior cladding piece of FIG. 10 with an adjustable extension piece for a flush fin type installation, with the extension piece being in a fully extended position.

FIGS. 11 and 12 show the cladding member 142 with an extendable member 142*b* for use in a flush fin type application.

Figure 13:
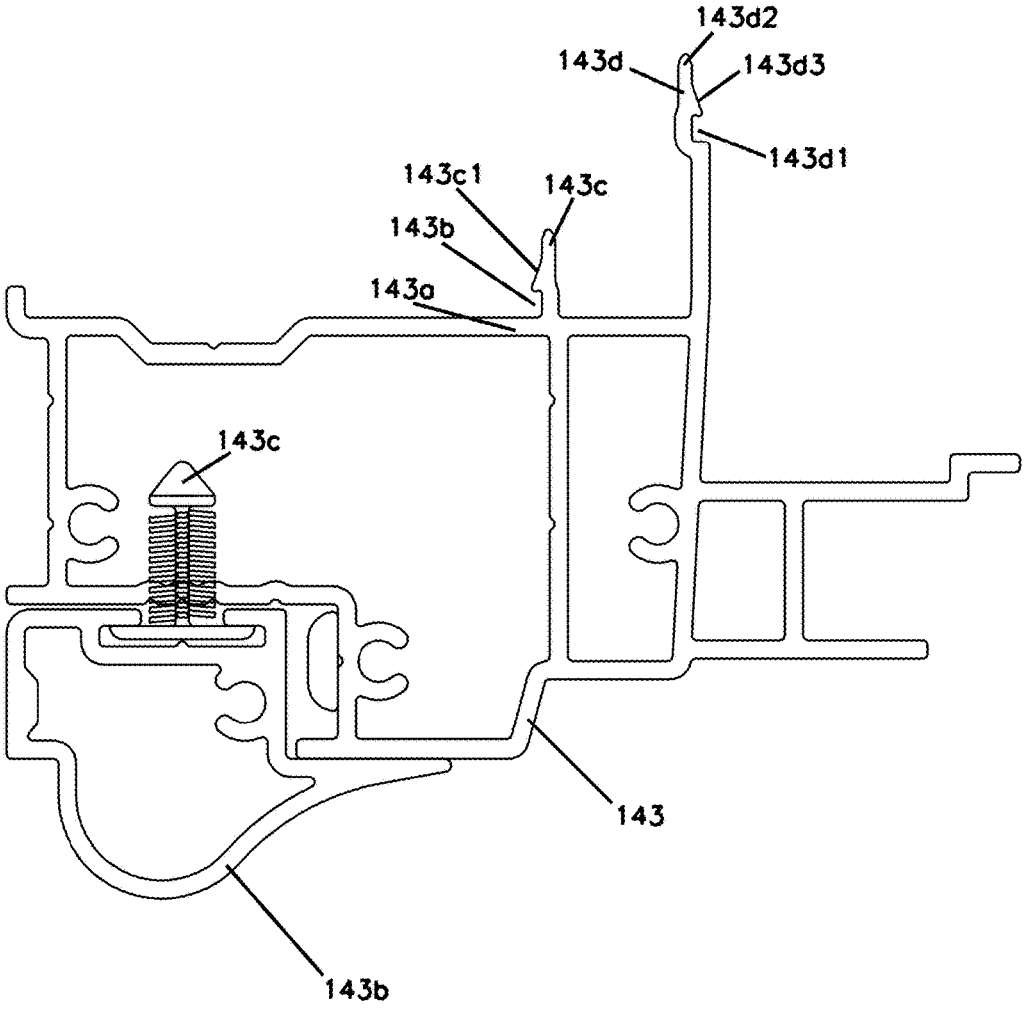
FIG. 13 is a cross-sectional view of a second exterior cladding piece suitable for attachment to the base frame members of FIG. 4-6 at a second attachment arrangement of the base frame members.

FIG. 13 shows a cladding assembly 143 in which multiple accessory covers 143*b* can be provided based on installation needs for slider and double hung type windows. In the embodiment shown, the accessory cover 143*b* is configured for a brick mold application. Notably, the accessory cover 143*b* conceals a fastener that secures the cladding assembly 143 to a building structure, where one is utilized. The configuration shown in FIG. 13 is further shown and described in U.S. patent application Ser. No. 14/838,798, filed on Aug. 28, 2015 and entitled WINDOW SYSTEM WITH INTERCHANGEABLE EXTERIOR ACCESSORY COVERS.

Figure 14:
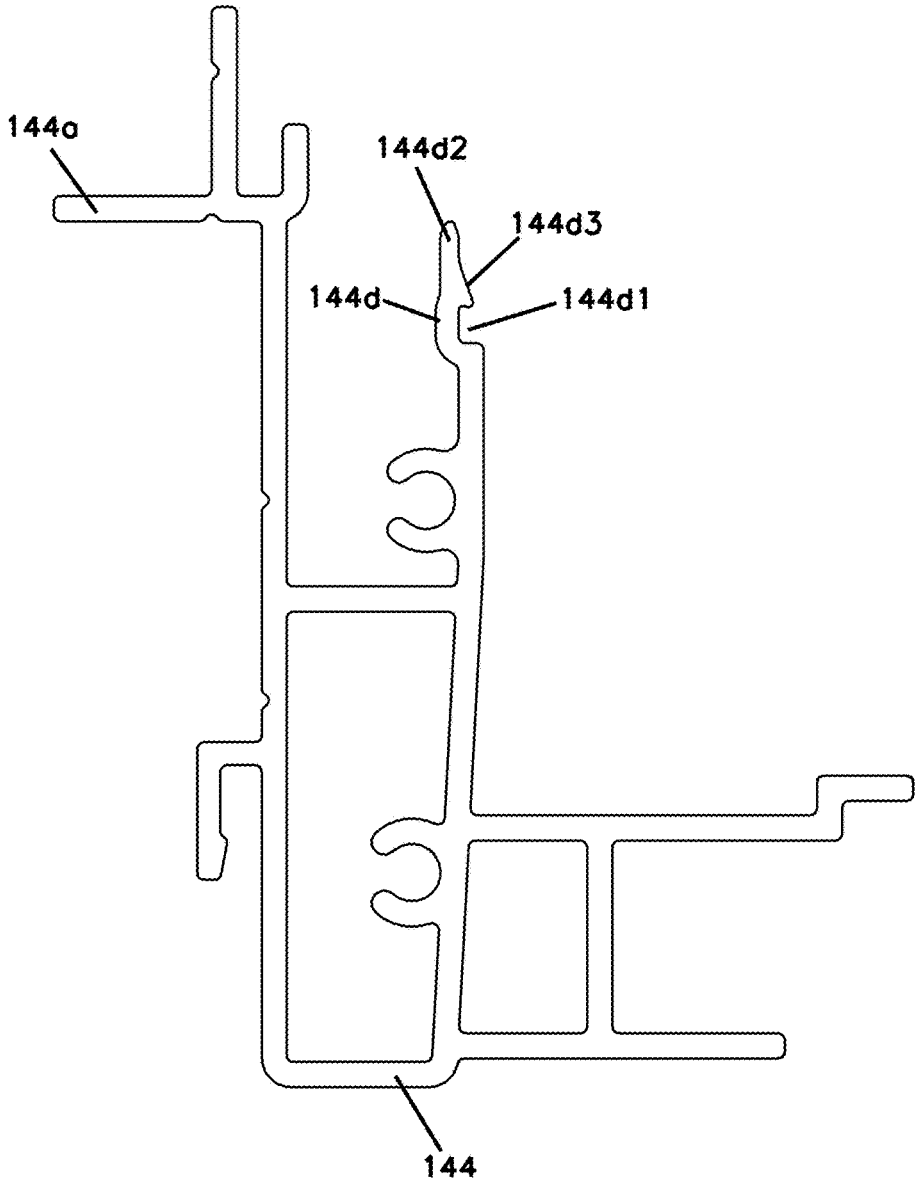
FIG. 14 is a cross-sectional view of a third exterior cladding piece suitable for attachment to the base frame members of FIG. 4-6 at a second attachment arrangement of the base frame members.

FIG. 14 shows a cladding member 144 which is configured to be utilized in conjunction with base frame member 117 to form a jamb in a pocket window.

Figure 15:
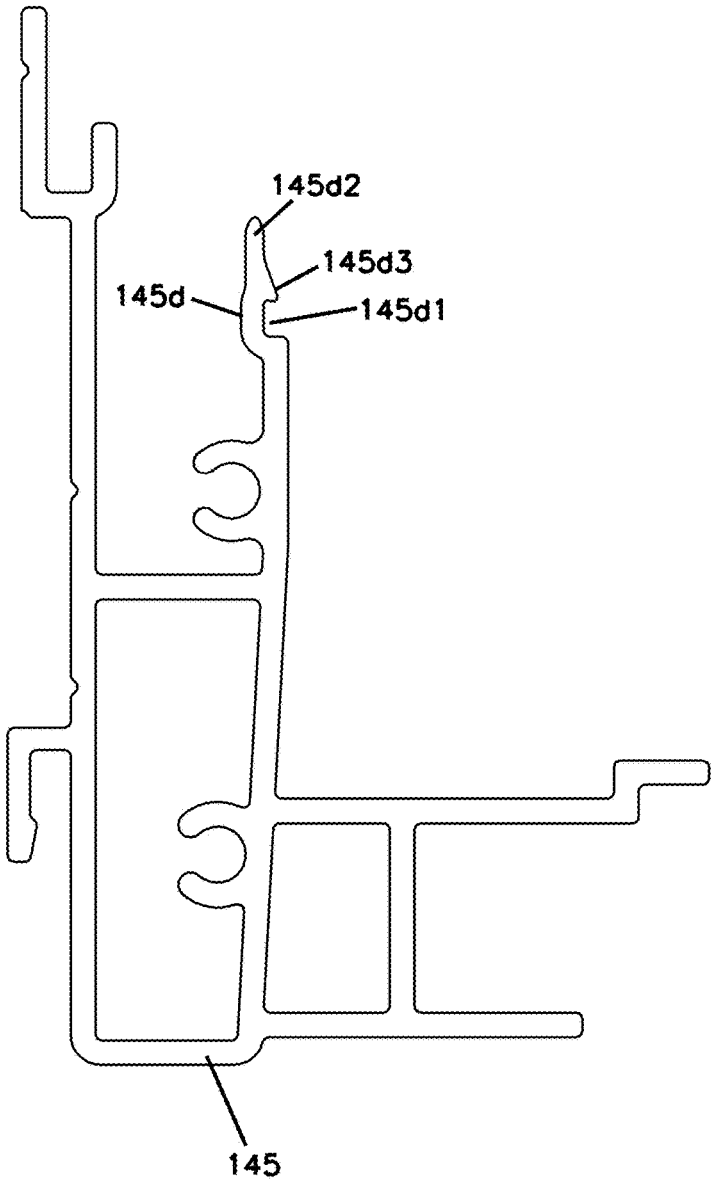
FIG. 15 is a cross-sectional view of a fourth exterior cladding piece suitable for attachment to the base frame members of FIG. 4-6 at a second attachment arrangement of the base frame members.

FIG. 15 shows a cladding member 145 which is configured to be utilized in conjunction with base frame member 117 to form a jamb in an insert window.

Figure 16:
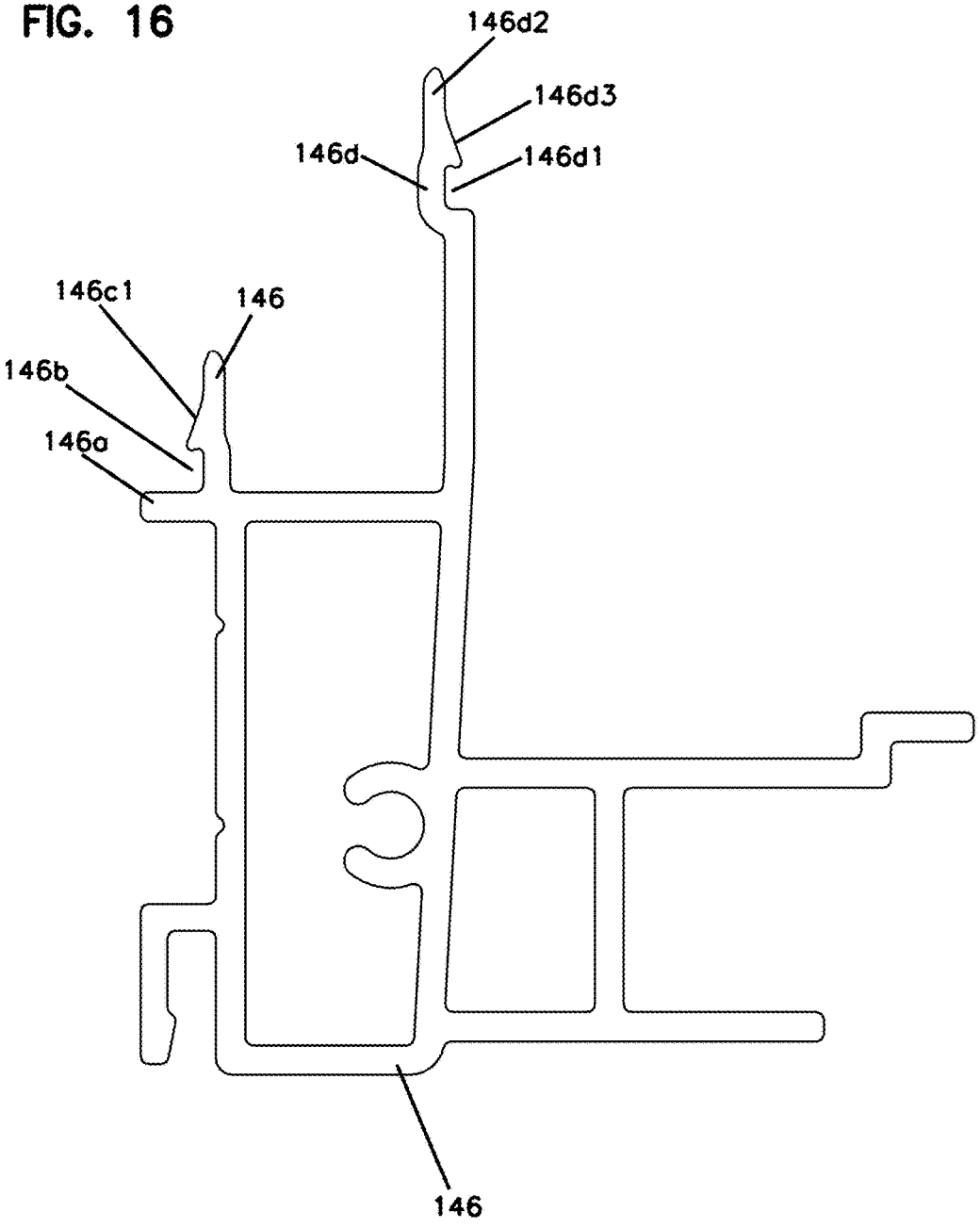
FIG. 16 is a cross-sectional view of a fifth exterior cladding piece suitable for attachment to the base frame members of FIG. 4-6 at a second attachment arrangement of the base frame members.

FIG. 16 shows a cladding member 146 configured to be utilized with a base frame member 113, 115 to form a header or jamb in a double hung or slider window.

Figure 17:
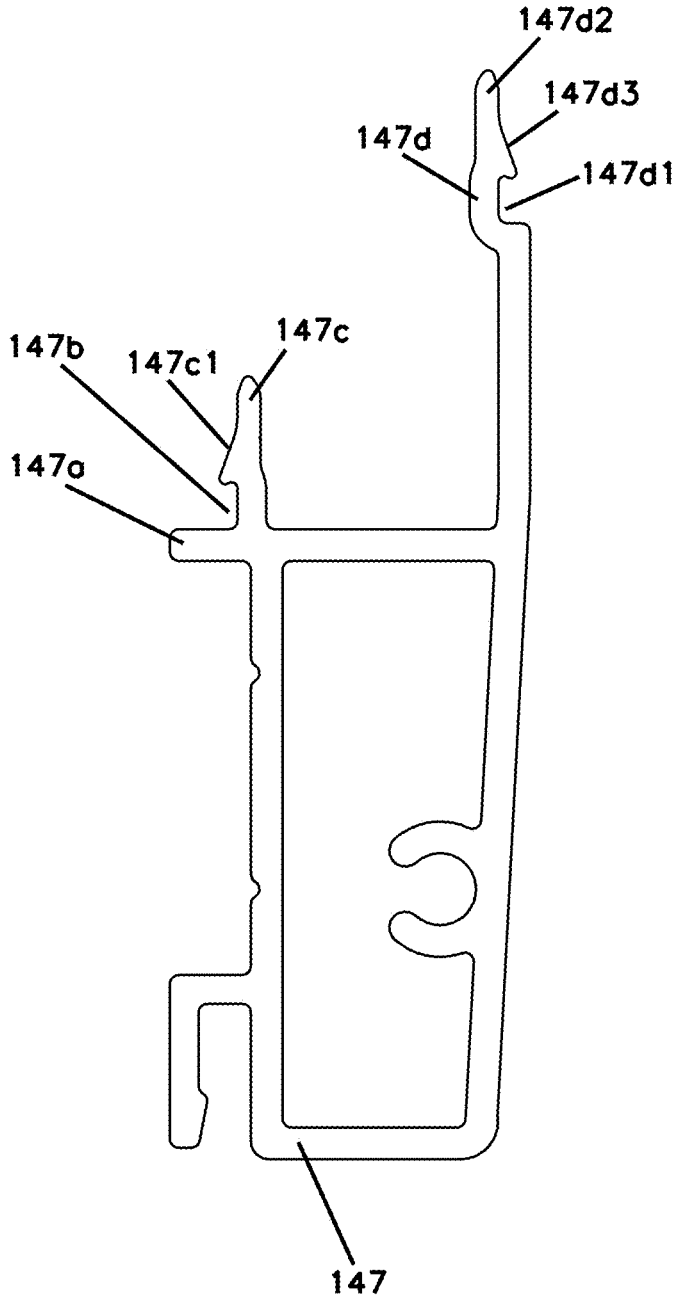
FIG. 17 is a cross-sectional view of a sixth exterior cladding piece suitable for attachment to the base frame members of FIG. 4-6 at a second attachment arrangement of the base frame members.

FIG. 17 shows a cladding member 147 configured to be utilized with a base frame member 113, 115 to form a header, jamb, or sill of a casement window.

Figure 18:
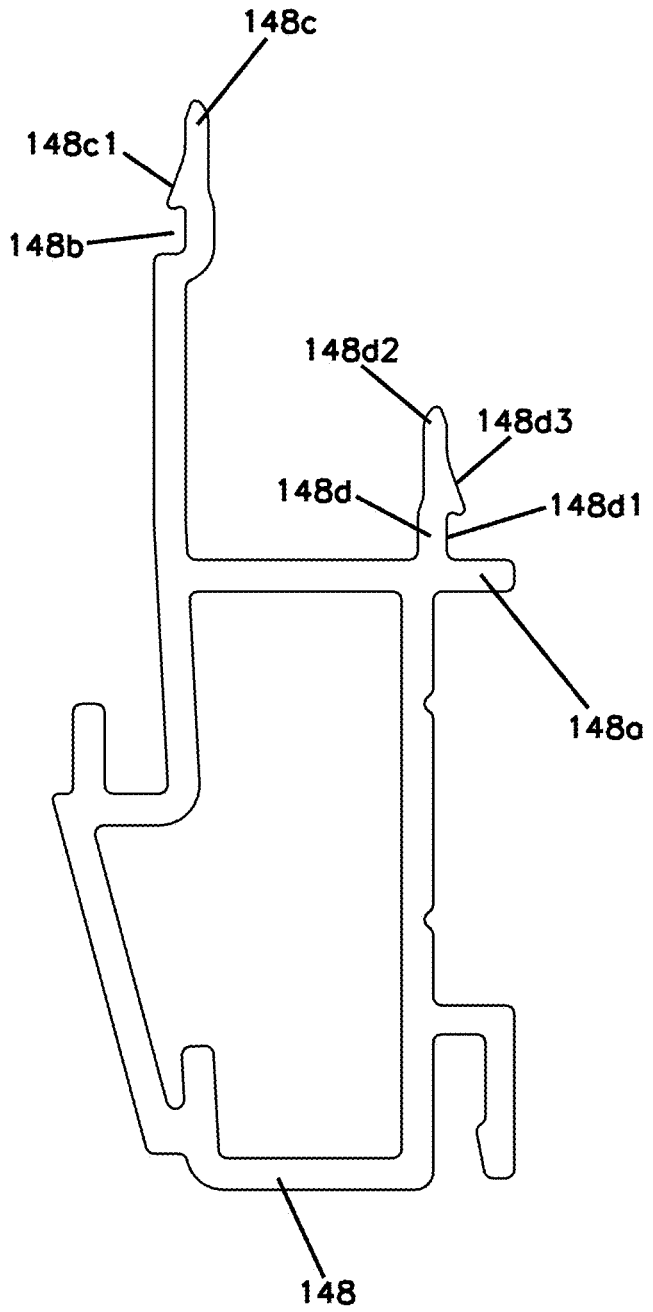
FIG. 18 is a cross-sectional view of a seventh exterior cladding piece suitable for attachment to the base frame members of FIG. 4-6 at a second attachment arrangement of the base frame members.

FIG. 18 shows a cladding member 148 configured to be utilized with a base frame member 113, 115 to form a sill of a slider or double hung window.

As noted above, FIGS. 19 to 26 show various embodiments of the interior assemblies 150 that are usable with the base frame member 113, 115, and/or 117.

Figure 19:
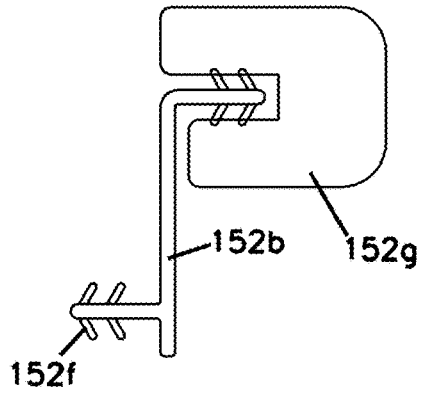
FIG. 19 is a cross-sectional view of a first interior assembly suitable for attachment to the base frame members of FIG. 4-6 at a third attachment arrangement of the base frame members.
Figure 19:
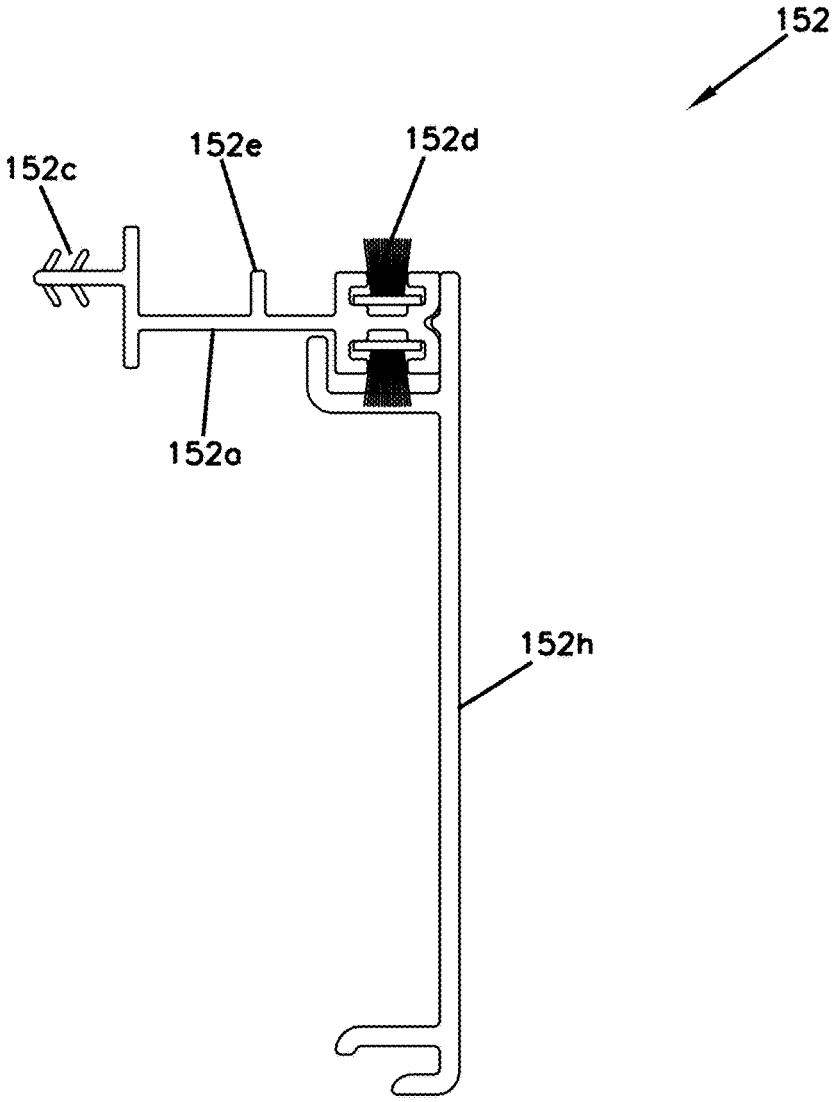

FIG. 19 shows an interior assembly 152 including a first part 152*a* configured to be inserted into kerf 113*a* and a second part 152*b* configured to be inserted into kerf 113*b* of a base frame member used as a jamb for a slider type window. The first part 152*a* includes a connector portion 152*c*, a brush part 152*d* and a parting stop 152*e*. The second part 152*b* includes a connector portion 152*f* and a trim piece 152*g*. The interior assembly 152 also includes an additional extension member 152*h* that bridges from the first part 152*a* and a cladding member attached to the base frame member.

Figure 20:
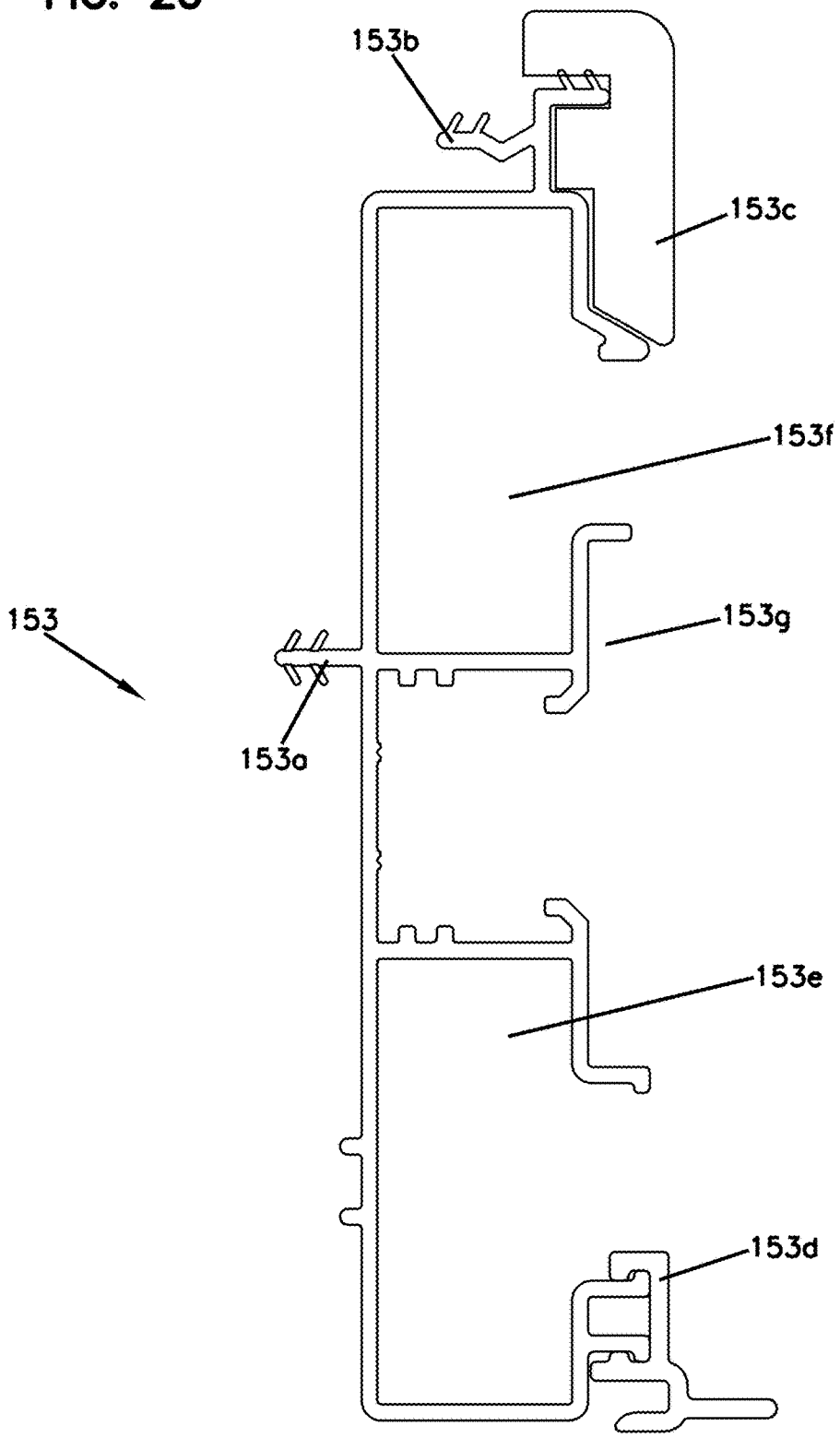
FIG. 20 is a cross-sectional view of a second interior assembly suitable for attachment to the base frame members of FIG. 4-6 at a third attachment arrangement of the base frame members.

FIG. 20 shows an interior assembly 153, such as a jamb liner, which connects to a base frame member 113, 115 at the first and second kerfs 113*a*, 113*b* via connector portions 153*a*, 153*b* in a double hung window jamb application. The interior assembly 153 also includes a trim piece 153*c* and a trim part 153*d* and also defines cavities 153*e*, 153*f* for retaining components of the window such as counterbalance weights. The interior assembly 153 also defines a channel 153*g* within which the window sashes can slide.

Figure 21:
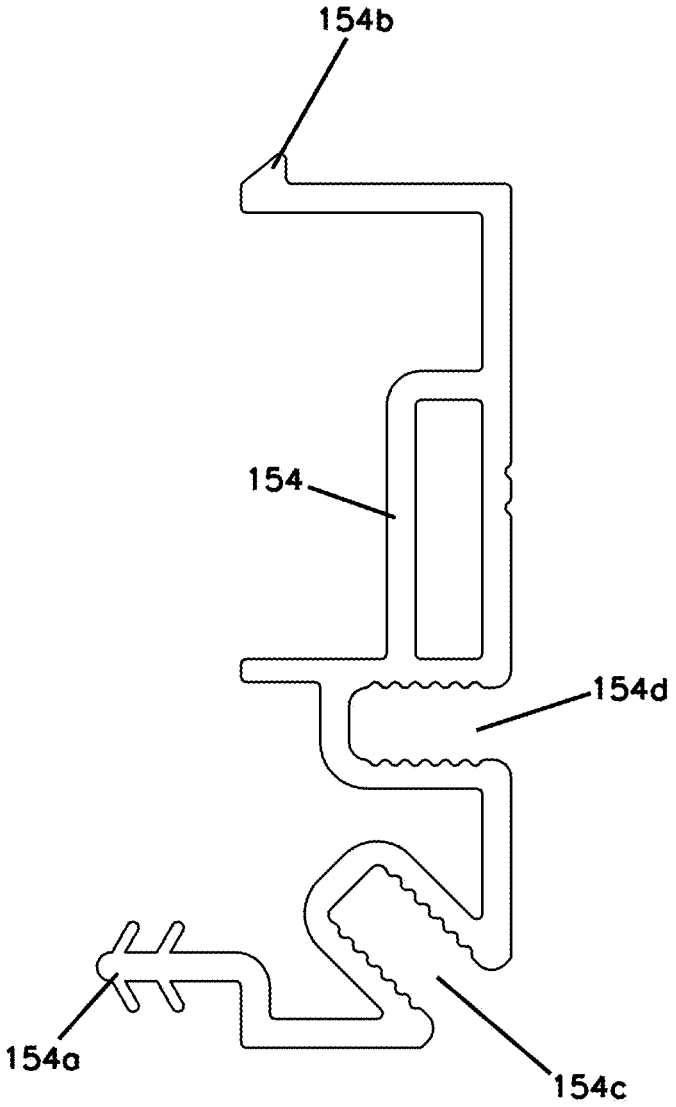
FIG. 21 is a cross-sectional view of a third interior assembly suitable for attachment to the base frame members of FIG. 4-6 at a third attachment arrangement of the base frame members.

FIG. 21 shows an interior assembly 154 that can be used with the base frame member 113, 115 to form a casement window jamb, and includes a first connection portion 154*a* for engagement with kerf 113*a* and a second connection portion 154*b* for connection with the recess 113*p*. The interior assembly also includes attachment locations 154*c* and 154*d* for accepting additional components to fully form a window jamb. In some embodiments, the interior assembly 154 can be integrally molded with the base frame member 113, 115.

Figure 22:
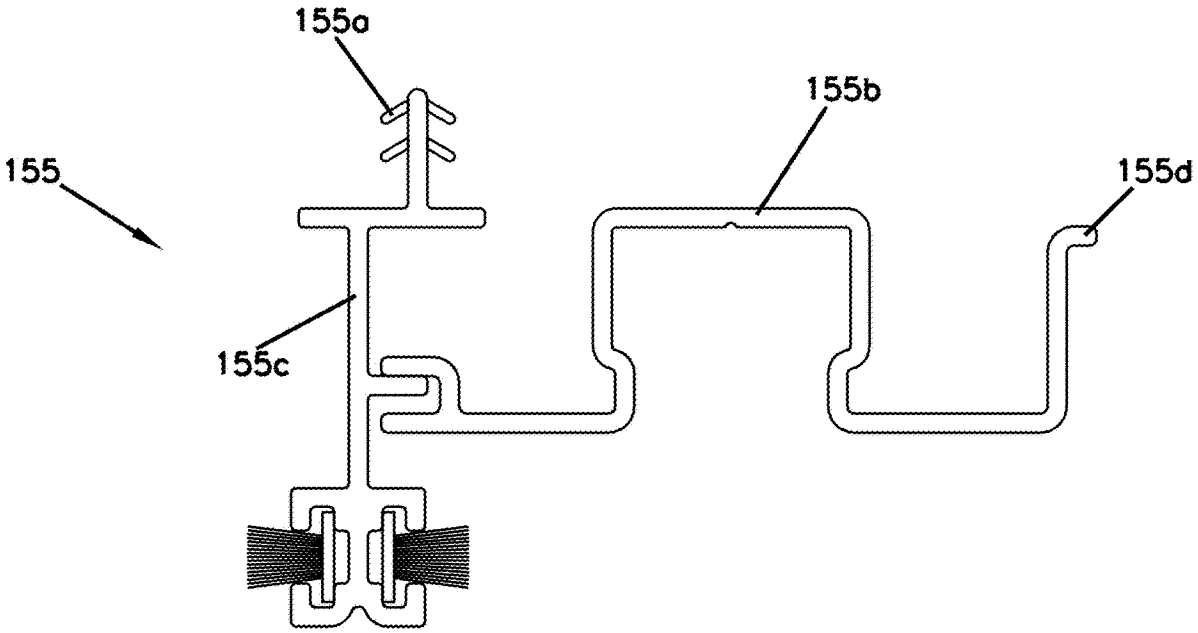
FIG. 22 is a cross-sectional view of a fourth interior assembly suitable for attachment to the base frame members of FIG. 4-6 at a third attachment arrangement of the base frame members.

FIG. 22 shows an interior assembly 155 that can be used with the base frame member 113, 115 to form a header for a slider window. As shown, interior assembly 155 includes a first part 155*a* and a second part 155*b*. The first part 155*a* includes a first connection portion 155*c* for engagement with kerf 113*a* while the second part includes a second connection portion 155*d* for connection with the recess 113*p*.

Figure 23:
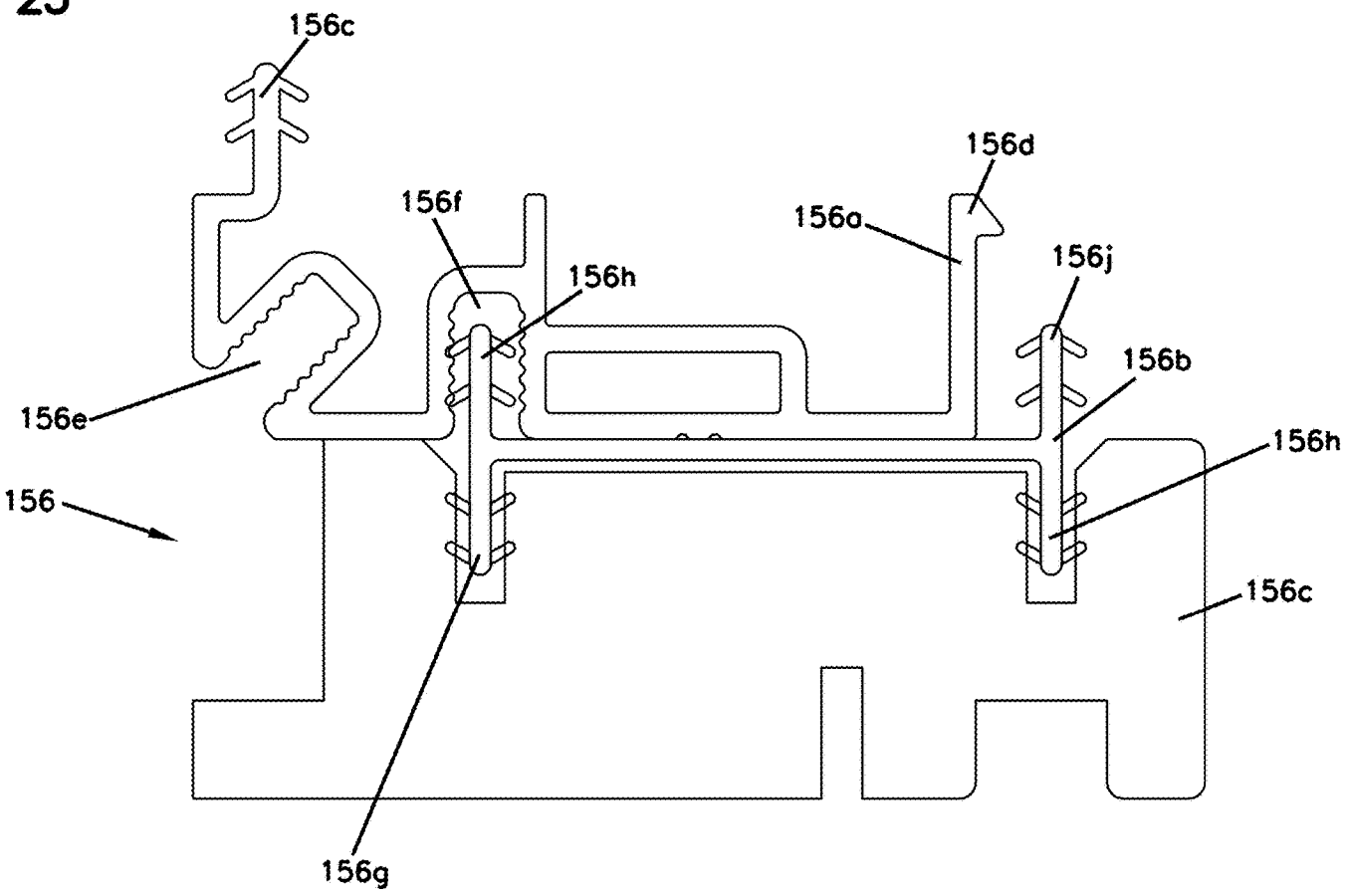
FIG. 23 is a cross-sectional view of a fifth interior assembly suitable for attachment to the base frame members of FIG. 4-6 at a third attachment arrangement of the base frame members.

FIG. 23 shows an interior assembly 156 that can be used with the base frame member 113, 115 to form a header for a casement window. As shown, interior assembly 156 includes a first part 156*a*, a second part 156*b*, and a third part 156*c* that is connected to the first part 156*a* via the second part 156*b*. Notably, the first part 156*a* is the same as the interior assembly 154 shown at FIG. 21 which is used for the casement window jambs. Accordingly, the first part 156*a* includes a first connection portion 156*d* for engagement with kerf 113*a* and a second connection portion 156*e* for connection with the recess 113*p*. The third part 156*c* is a trim piece while the second part 156*b* has connector parts 156*g*, 156*h* that extend into recesses of the third part 156*c*, a connector part 156*h* that extends into recess 156*f*, and a fourth connector part 156*j* that extends into the kerf 113*b* of the base frame.

Figure 24:
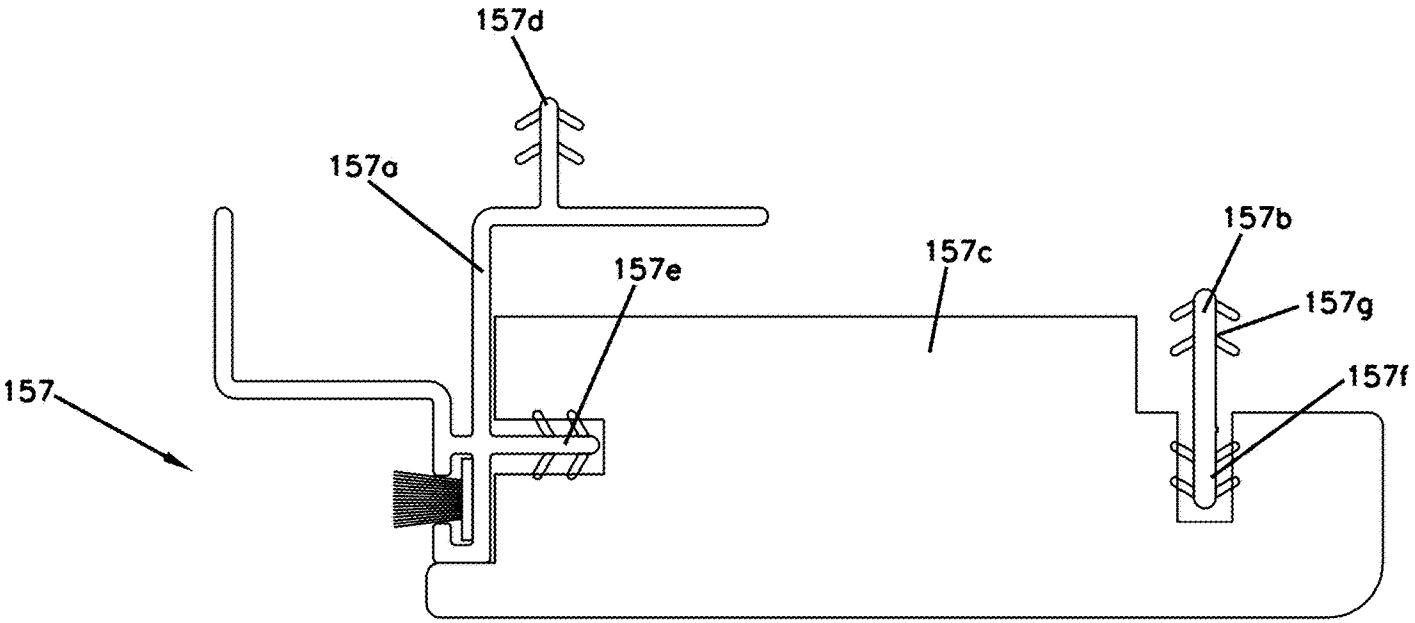
FIG. 24 is a cross-sectional view of a sixth interior assembly suitable for attachment to the base frame members of FIG. 4-6 at a third attachment arrangement of the base frame members.

FIG. 24 shows an interior assembly 157 that can be used with the base frame member 113, 115 to form a header in a double hung window or jamb in a slider-type window. As shown, interior assembly includes a first part 157*a*, a second part 157*b*, and a third part 157*c* that is a trim piece. The first part 157*a* includes a connection portion 157*d* for engagement with kerf 113*a* and a connection portion 157*e* that engages into a recess of the third part 157*c*. The second part 157*b* is a double connector with a connection portion 157*f* that engages into a recess of the third part 157*c* and with a connection portion 157*g* that engages with kerf 113*b* of the base frame member.

Figure 25:
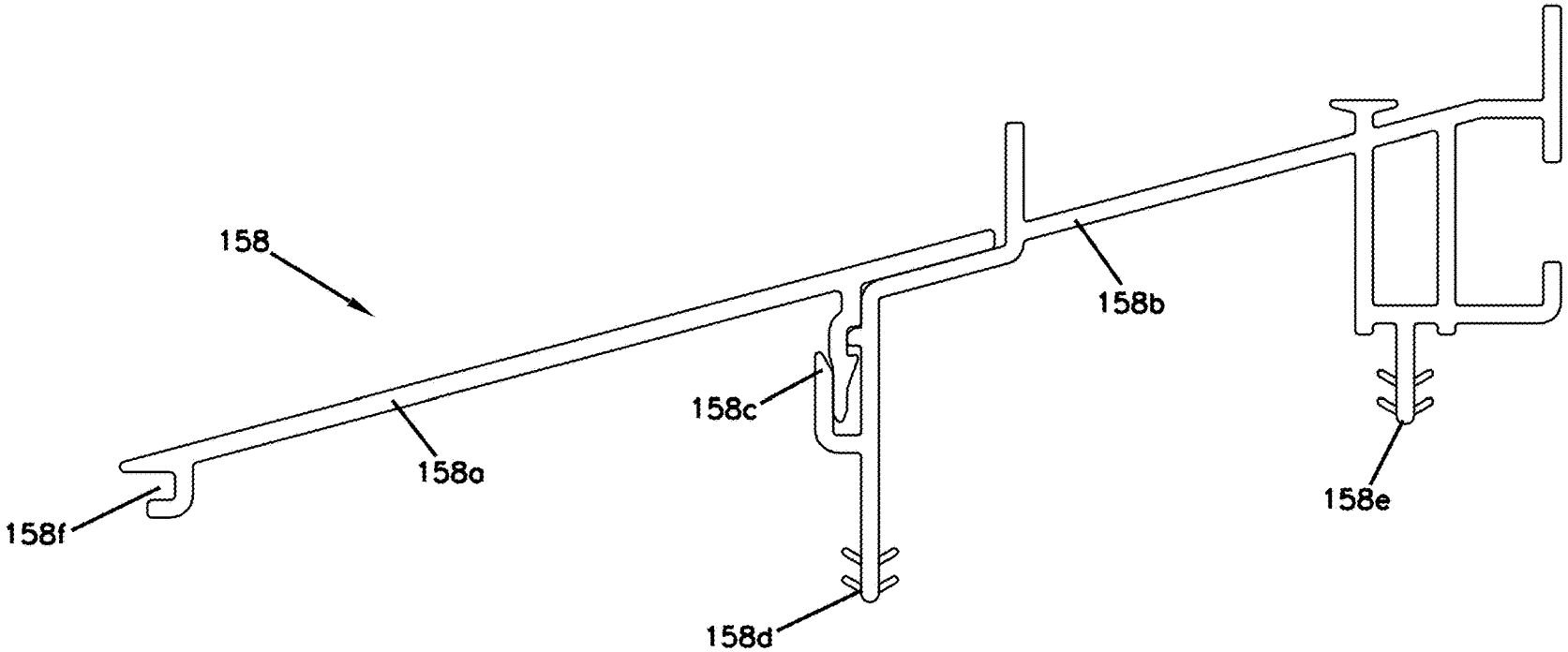
FIG. 25 is a cross-sectional view of a seventh interior assembly suitable for attachment to the base frame members of FIG. 4-6 at a third attachment arrangement of the base frame members.

FIG. 25 shows an interior assembly 158 that can be used with the base frame member 113, 115 to form a sloped sill in a slider or double hung window application. The interior assembly 158 includes a first part 158*a* and a second part 158*b* that a joined together at a snap-fit connection point 158*c*. The second part 158*b* includes a first connection portion 158*d* that engages with kerf 113*a* of the base frame member and a second connection portion 158*e* that engages with the kerf 113*b* of the base frame member. The first part includes a connection portion 158*f* configured to engage with a portion of a cladding member attached to the base frame member.

Figure 26:
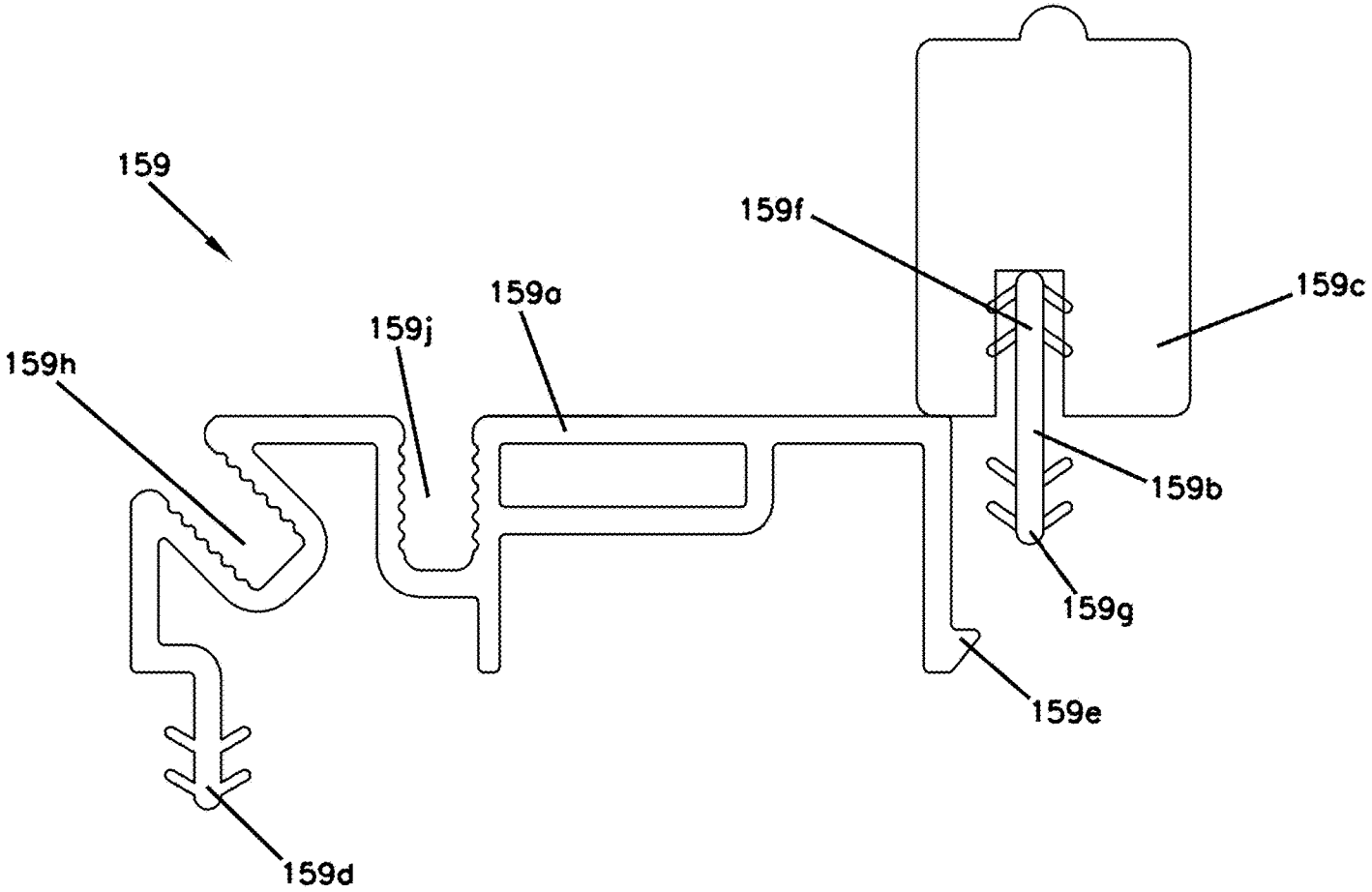
FIG. 26 is a cross-sectional view of an eighth interior assembly suitable for attachment to the base frame members of FIG. 4-6 at a third attachment arrangement of the base frame members.

FIG. 26 shows an interior assembly 159 that can be used with the base frame member 113, 115 to form a sill for a casement window. As shown, interior assembly 159 includes a first part 159*a*, a second part 159*b*, and a third part 159*c*. Notably, the first part 159*a* is the same as the interior assemblies 154, 156*a* shown at FIGS. 21 and 23 which are used for the casement window jambs and header, respectively. Accordingly, the same interior assembly component (154, 156*a*, 159*a*) can be used on all four sides of the window. As shown, the first part 159*a* includes a first connection portion 159*d* for engagement with kerf 113*a* and a second connection portion 159*e* for connection with the recess 113*p*. The third part 159*c* is a trim piece while the second part 159 has a connector part 159*f* that extend into a recess of the third part 156*c* and a connector part 159*g* that engages with the kerf 113*b* of the base frame. The first part has additional connection portions 159*h* and 159*j* for additional components.

As related above, the base frame members 113, 115, 117 can be utilized to form a wide variety of window configurations with the disclosed cladding, trim, and interior assembly arrangements. FIGS. 27 to 39 show examples of such configurations, as described below.

Figure 27:
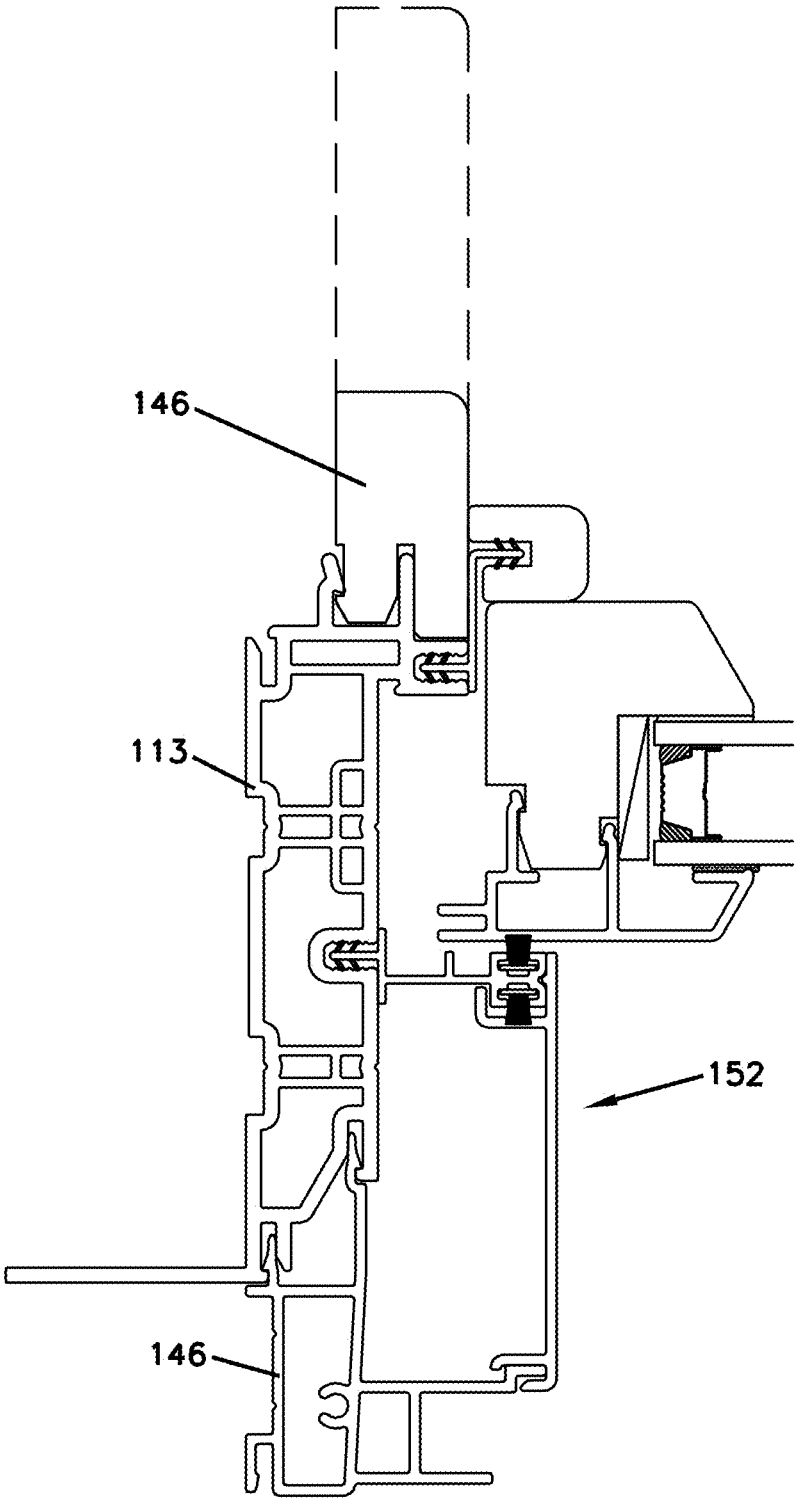
FIG. 27 is a cross-sectional view of a portion of an exemplary window assembly including the base frame member of FIG. 1 and selected components shown in FIGS. 7 to 26.

FIG. 27 shows a configuration where the base frame member 113, the trim piece 133, the cladding member 146, and the interior assembly 152 have been assembled together to form a new construction standard jamb assembly for a slider window.

Figure 28:
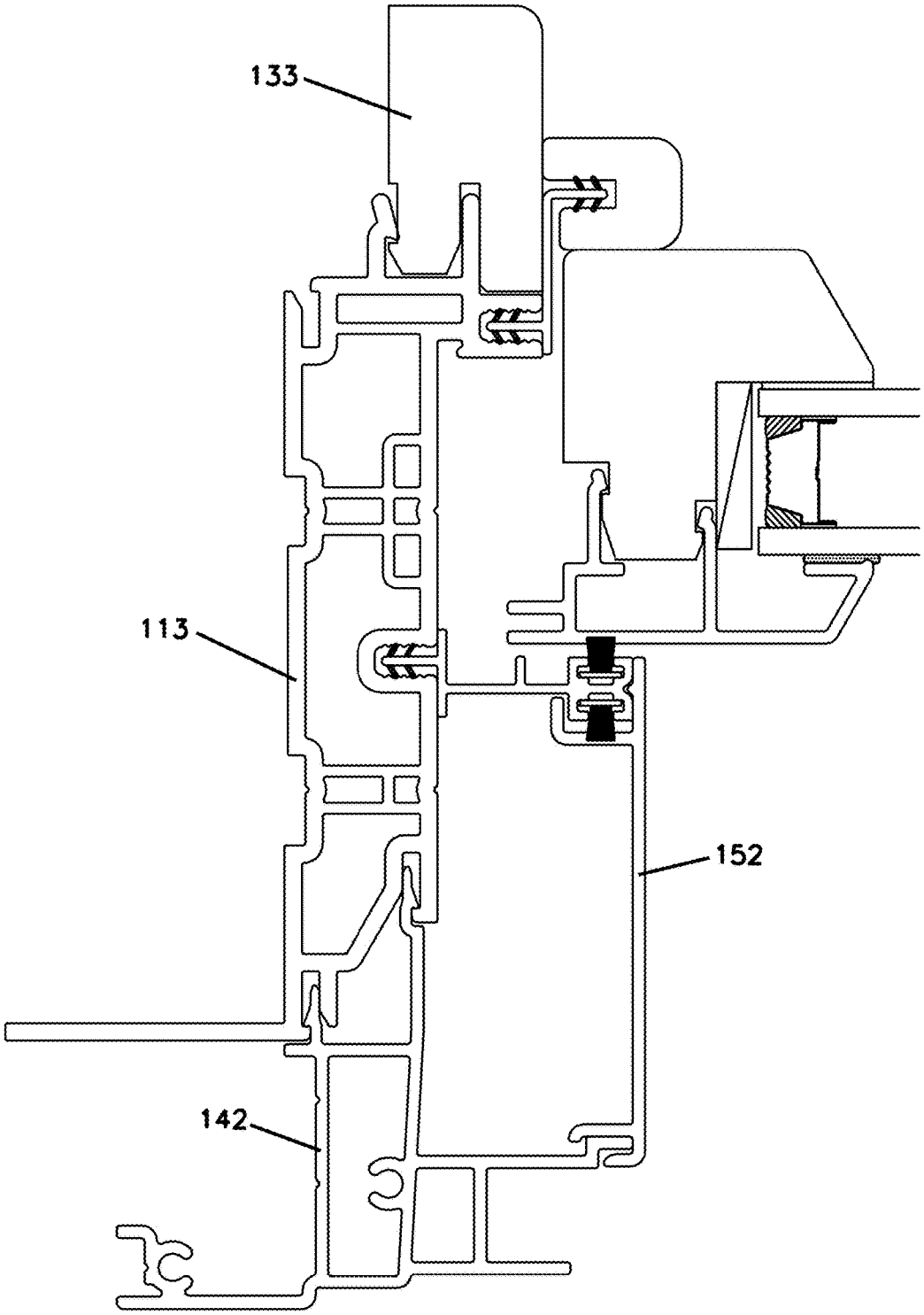
FIG. 28 is a cross-sectional view of a portion of an exemplary window assembly including the base frame member of FIG. 1 and selected components shown in FIGS. 7 to 26.

FIG. 28 shows a configuration where the base frame member 113, the trim piece 133, the cladding member 142, and the interior assembly 152 have been assembled together to form a new construction j-channel jamb assembly for a slider window.

Figure 29:
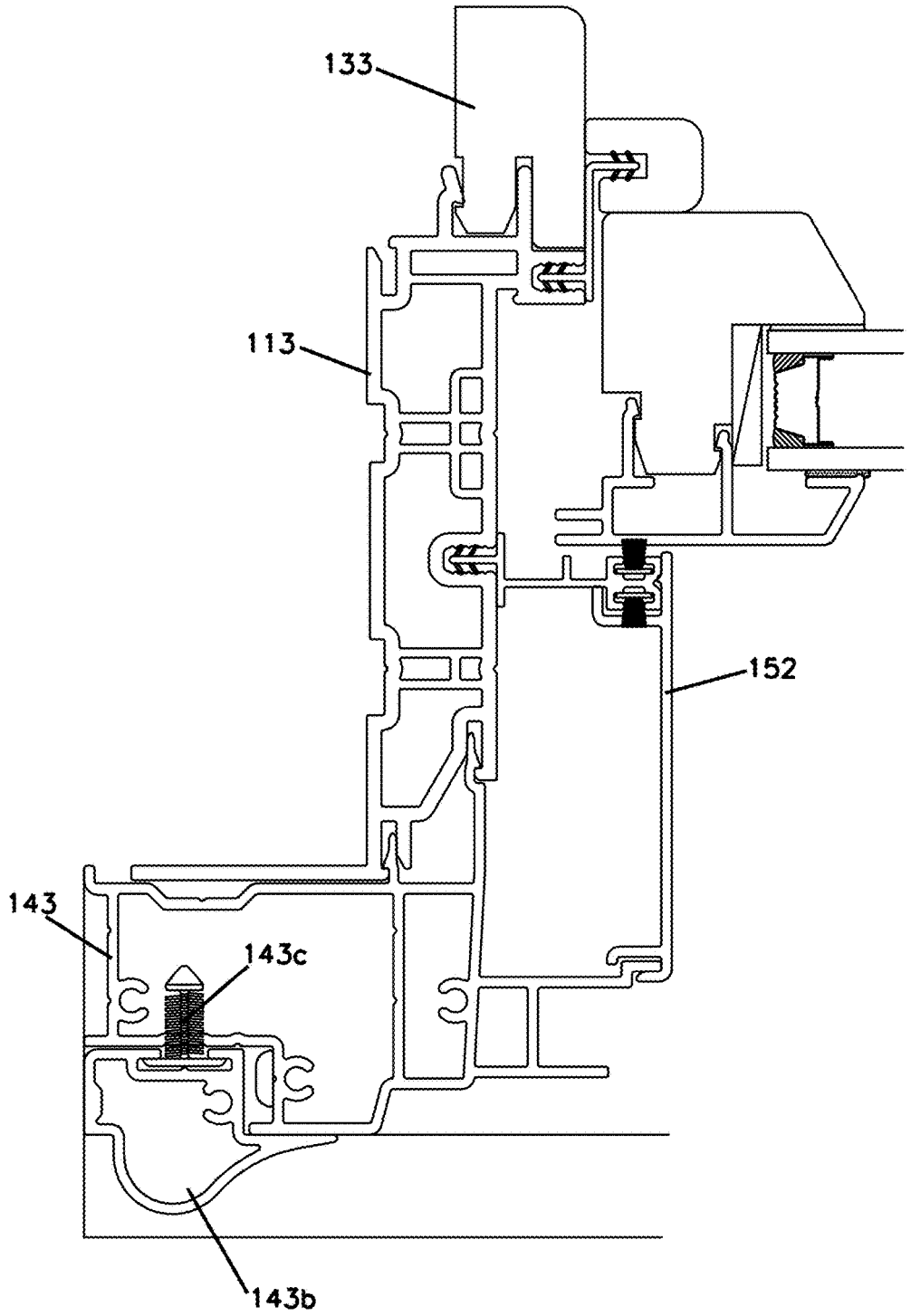
FIG. 29 is a cross-sectional view of a portion of an exemplary window assembly including the base frame member of FIG. 1 and selected components shown in FIGS. 7 to 26.

FIG. 29 shows a configuration where the base frame member 113, the trim piece 133, the cladding assembly 143, and the interior assembly 152 have been assembled together to form a jamb assembly for a slider window. As stated previously, multiple accessory covers 143*b* can be installed onto the cladding member 143 to suit various given installations. Ordinarily, such modularity would require that each possible variation be tested and approved to ensure that the assembly achieves a required minimum water or moisture penetration performance level. However, the disclosed construction of the base frame member 113 itself defines the water barrier plane independently of the frame cladding 143 and accessory covers 143*b* (i.e. water penetration resistance is achieved even without the accessory covers 143*b* installed). Accordingly, the disclosed design allows for many potential window variations without requiring performance testing and approval for each possible combination.

Figure 30:
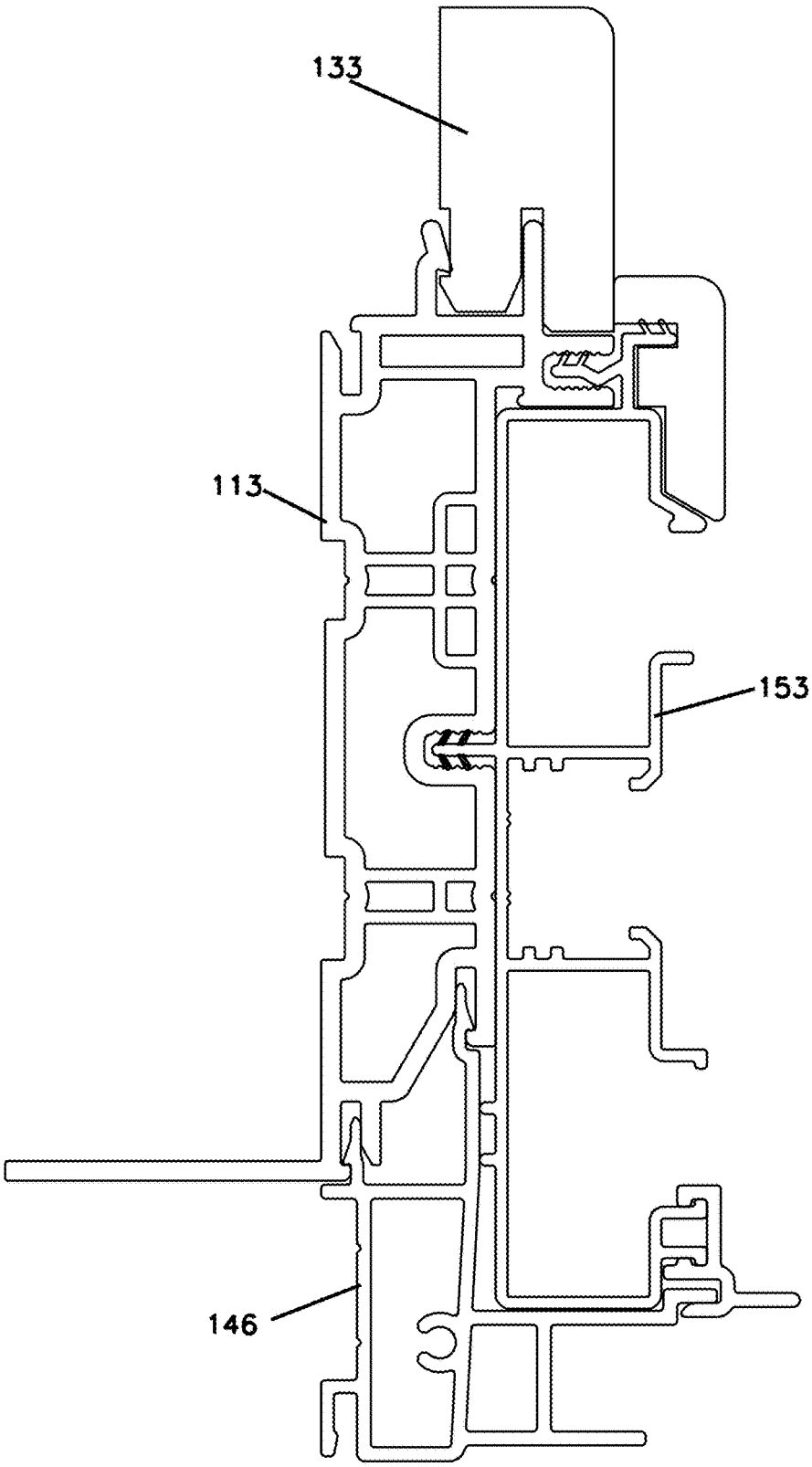
FIG. 30 is a cross-sectional view of a portion of an exemplary window assembly including the base frame member of FIG. 1 and selected components shown in FIGS. 7 to 26.

FIG. 30 shows a configuration where the base frame member 113, the trim piece 133, the cladding member 146, and the interior assembly 153 have been assembled together to form a jamb assembly for a double hung window.

Figure 31:
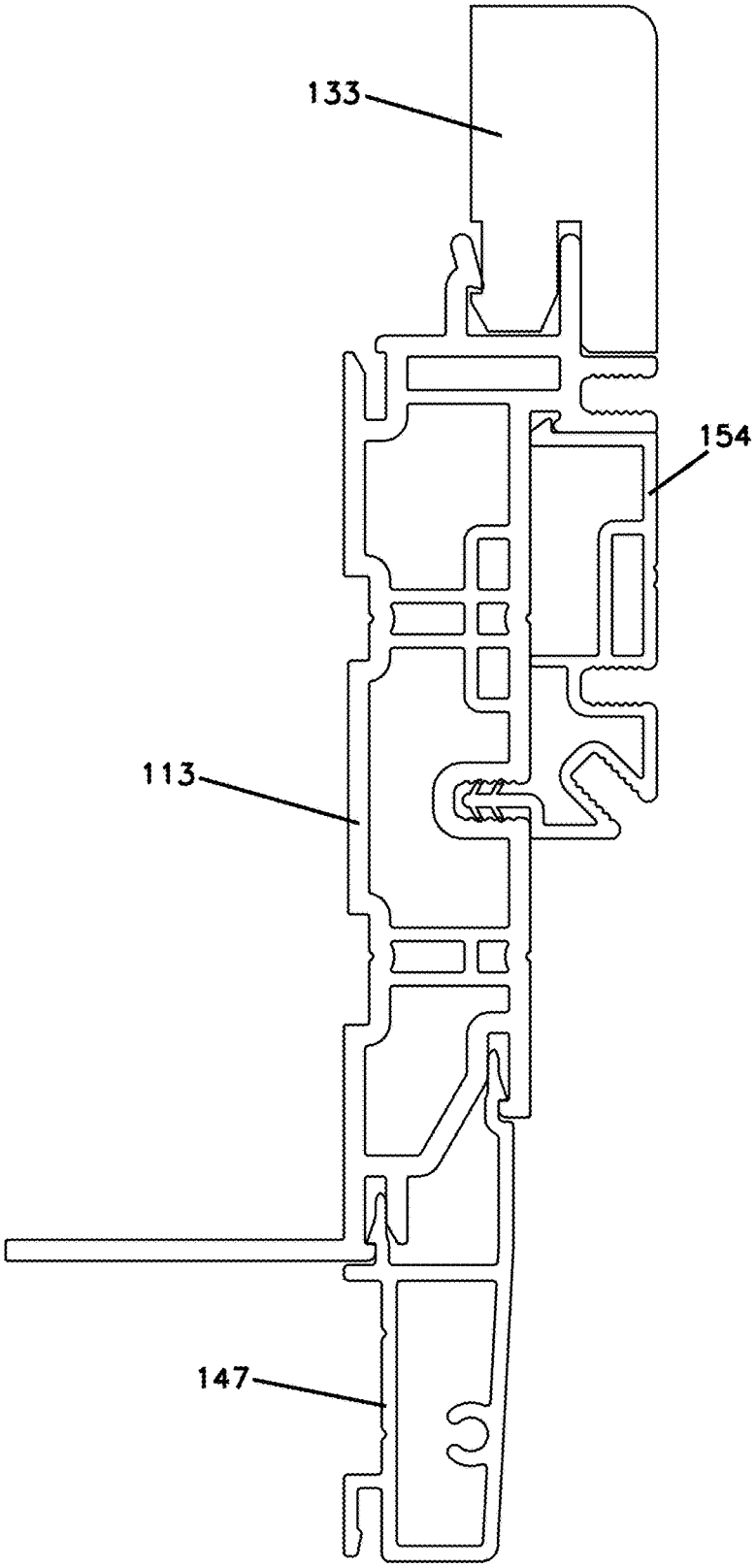
FIG. 31 is a cross-sectional view of a portion of an exemplary window assembly including the base frame member of FIG. 1 and selected components shown in FIGS. 7 to 26.

FIG. 31 shows a configuration where the base frame member 113, the trim piece 133, the cladding member 147, and the interior assembly 154 have been assembled together to form a jamb assembly and/or a header or sill subassembly for a casement window.

Figure 32:
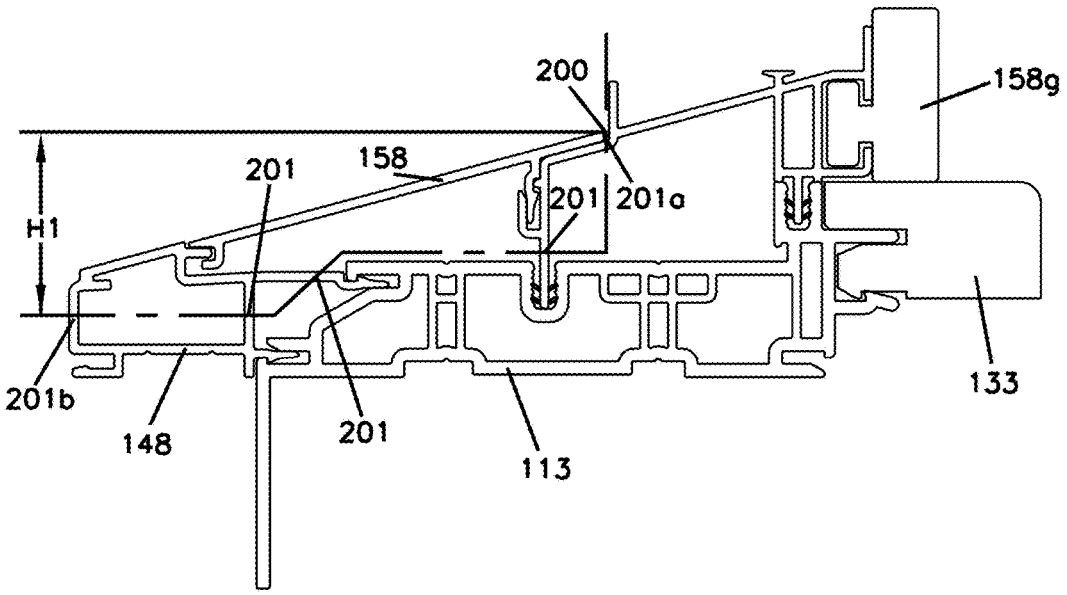
FIG. 32 is a cross-sectional view of a portion of an exemplary window assembly including the base frame member of FIG. 1 and selected components shown in FIGS. 7 to 26.
Figure 32A:
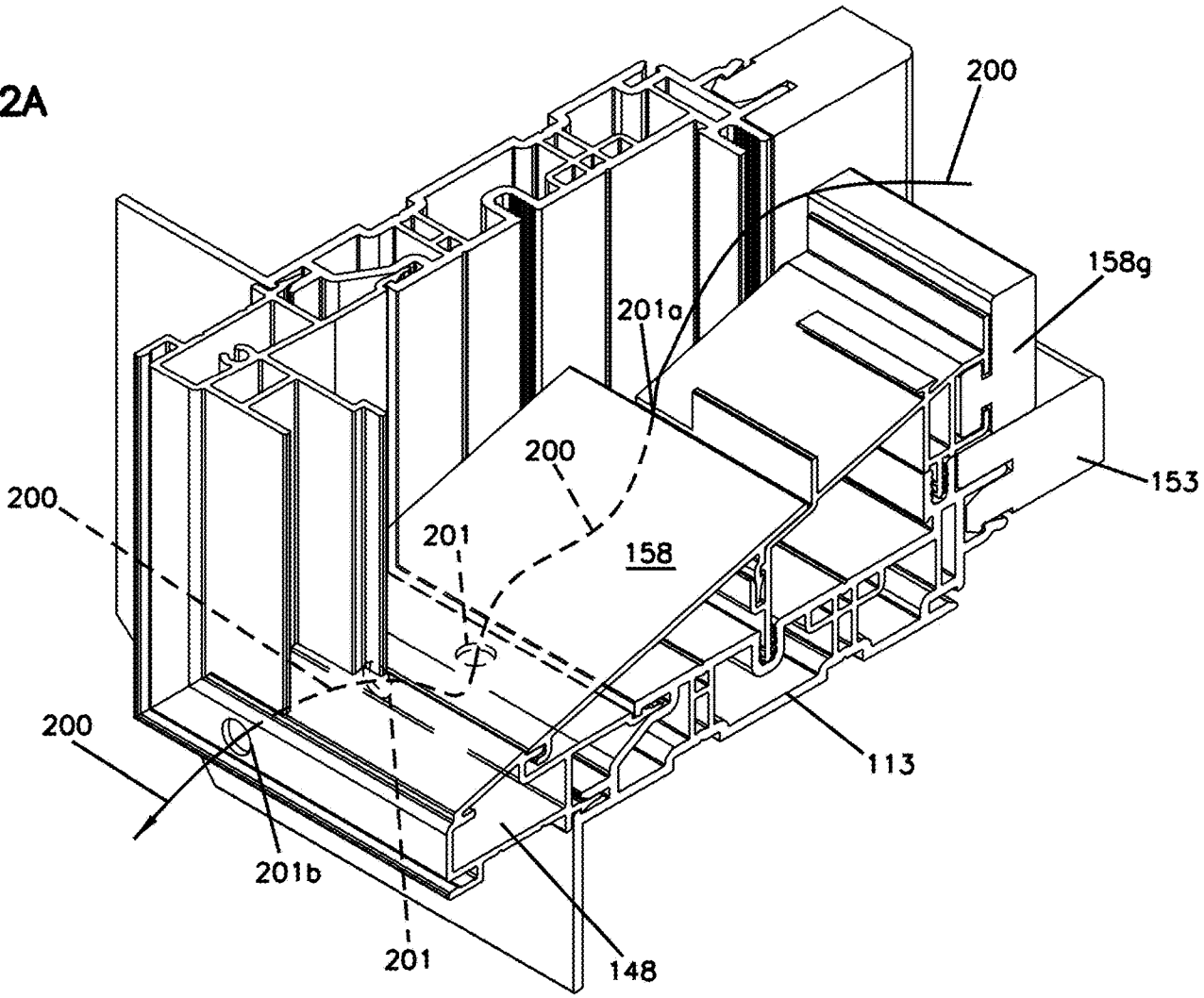
FIG. 32A is a perspective cross-sectional view of the window assembly shown in FIG. 32, illustrating a drainage path of the window assembly.

FIGS. 32 and 32A show a configuration where the base frame member 113, the trim piece 133, the cladding member 148, and the interior assembly 158 have been assembled together to form a sill assembly for a slider or double hung window, including an interstitial space 119 defined between the interior assembly 158 and the base frame member 113. An additional trim piece 158*g* of the assembly 158 is also shown at FIG. 32. As presented, the assembled sill defines a drain path 200 through weep holes, apertures, slots, gaps, or void areas 201 in the assembly 158 and cladding member 148. The water head height H1, defined as the height difference between the openings 201*a* where water enters the assembly 158 into the interstitial space 119, and the openings 201*b* where water exits the cladding members 148, is maximized by the low profile of the frame member 113. This increased height difference between the inlet and outlet of the drainage path increases drainage performance.

Figure 33:
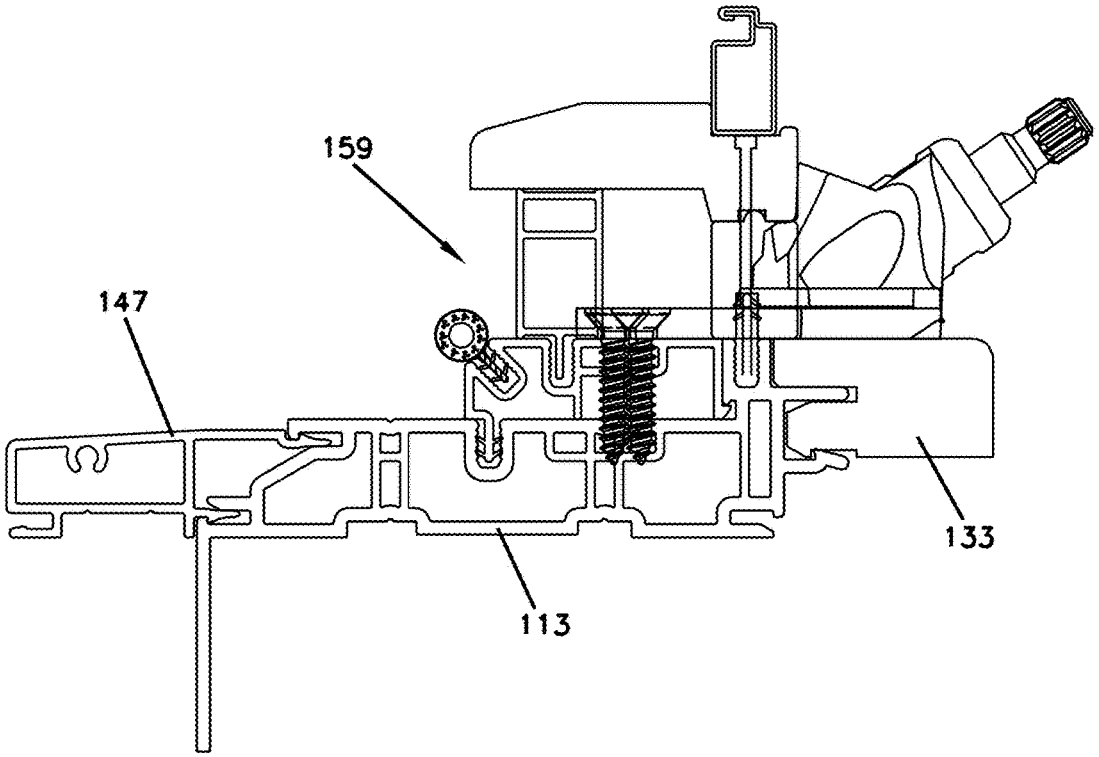
FIG. 33 is a cross-sectional view of a portion of an exemplary window assembly including the base frame member of FIG. 1 and selected components shown in FIGS. 7 to 26.

FIG. 33 shows a configuration where the base frame member 113, the trim piece 133, the cladding member 147, and the interior assembly 159 have been assembled together to form a sill for a casement window. As shown, additional components and trim pieces are attached to the interior assembly 159 to operate the window and to conceal the operating parts.

Figure 34:
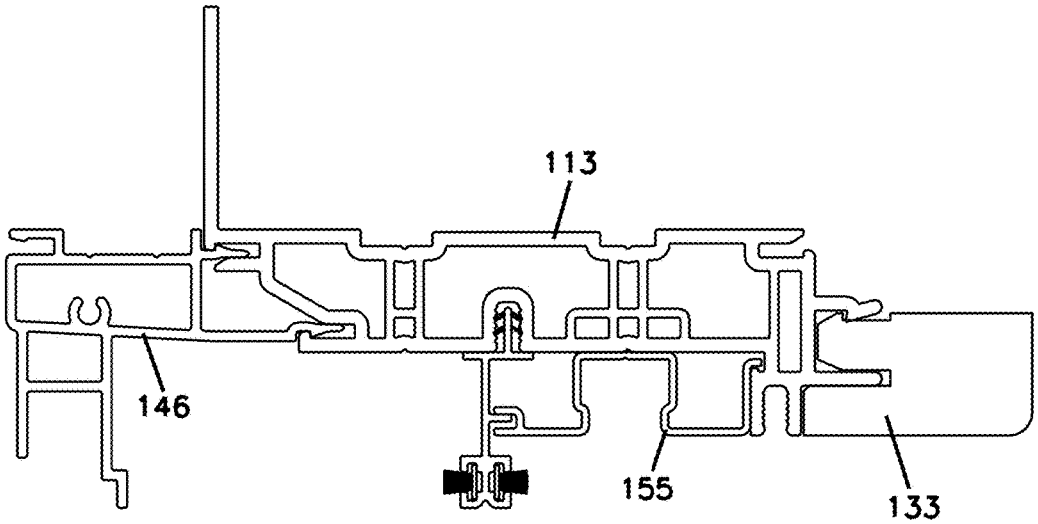
FIG. 34 is a cross-sectional view of a portion of an exemplary window assembly including the base frame member of FIG. 1 and selected components shown in FIGS. 7 to 26.

FIG. 34 shows a configuration where the base frame member 113, the trim piece 133, the cladding member 146, and the interior assembly 155 have been assembled together to form a header for a slider window.

Figure 35:
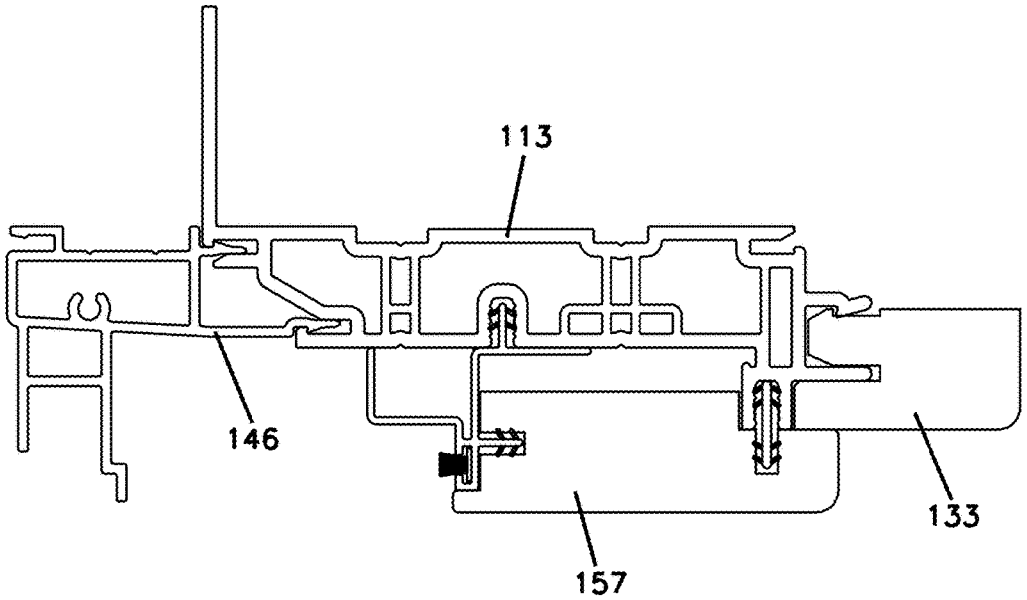
FIG. 35 is a cross-sectional view of a portion of an exemplary window assembly including the base frame member of FIG. 1 and selected components shown in FIGS. 7 to 26.

FIG. 35 shows a configuration where the base frame member 113, the trim piece 133, the cladding member 146, and the interior assembly 157 have been assembled together to form a header for a double hung window.

Figure 36:
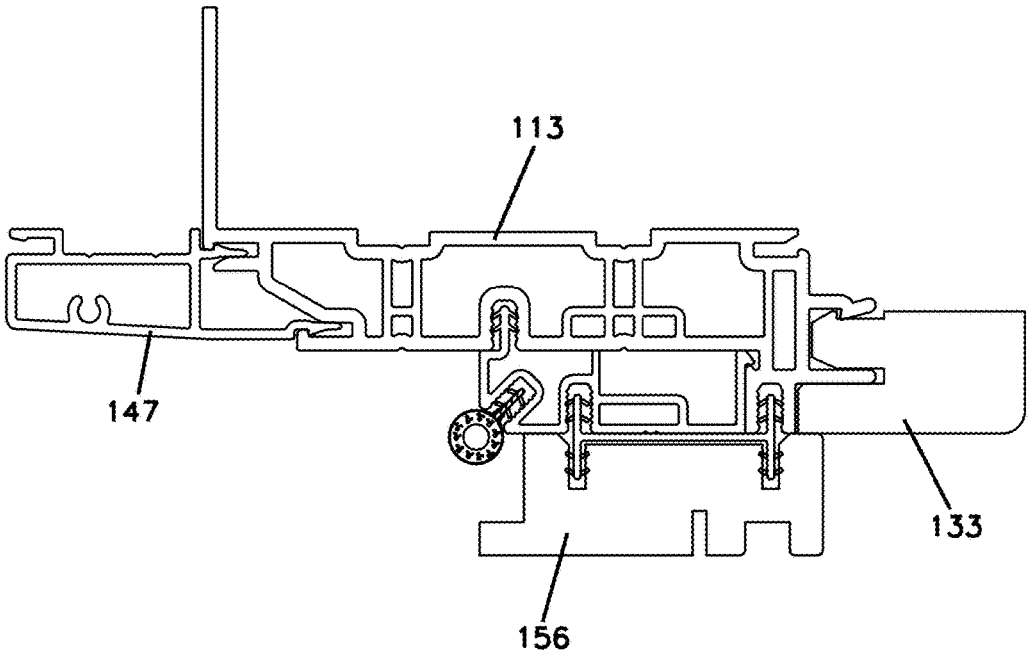
FIG. 36 is a cross-sectional view of a portion of an exemplary window assembly including the base frame member of FIG. 1 and selected components shown in FIGS. 7 to 26.

FIG. 36 shows a configuration where the base frame member 113, the trim piece 133, the cladding member 147, and the interior assembly 156 have been assembled together to form a header for a casement window.

Figure 37:
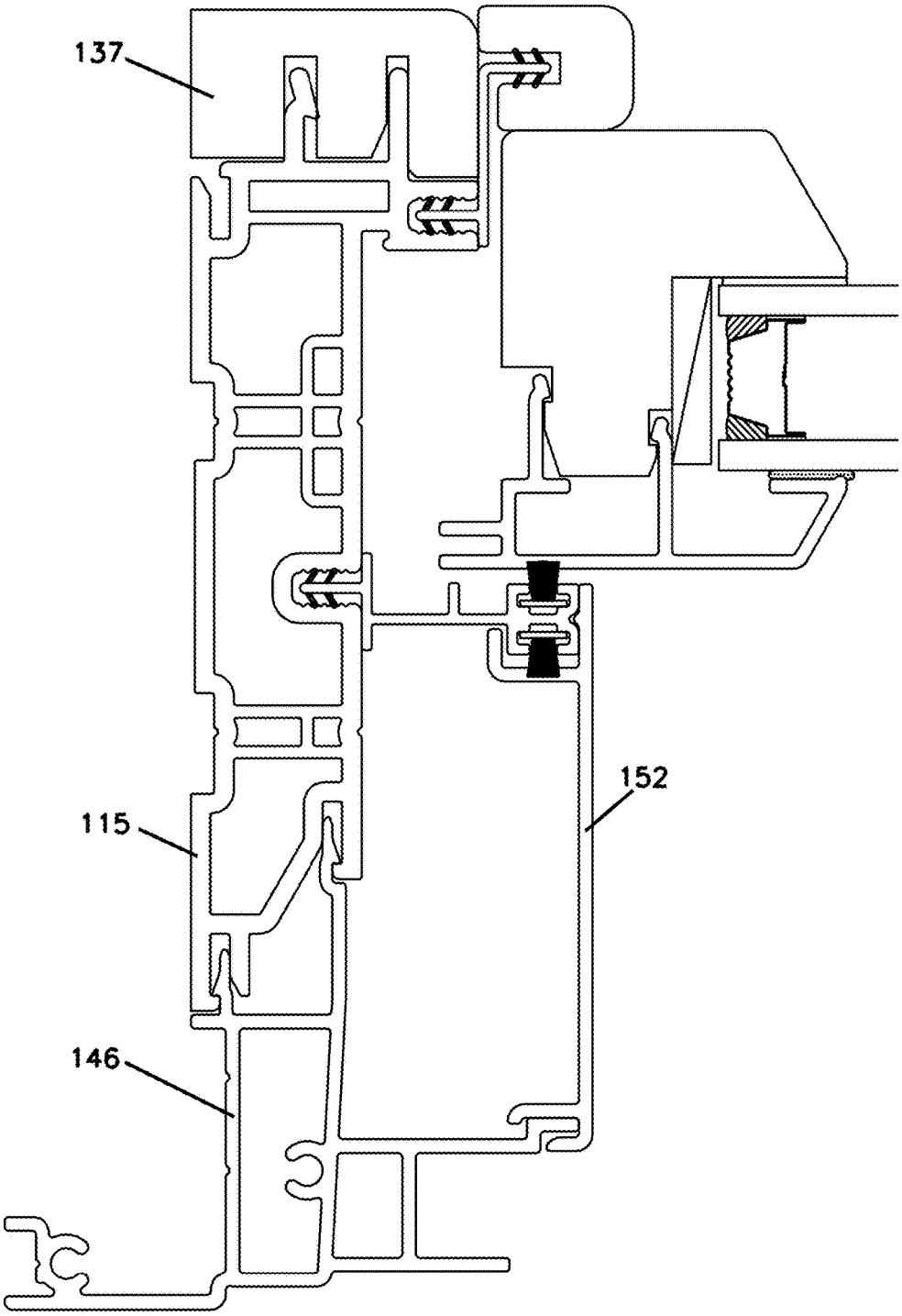
FIG. 37 is a cross-sectional view of a portion of an exemplary window assembly including the base frame member of FIG. 2 and selected components shown in FIGS. 7 to 26.

FIG. 37 shows a configuration where the base frame member 115, the trim piece 137, the cladding member 146, and the interior assembly 152 have been assembled together to form a flush fin jamb for a slider window.

Figure 38:
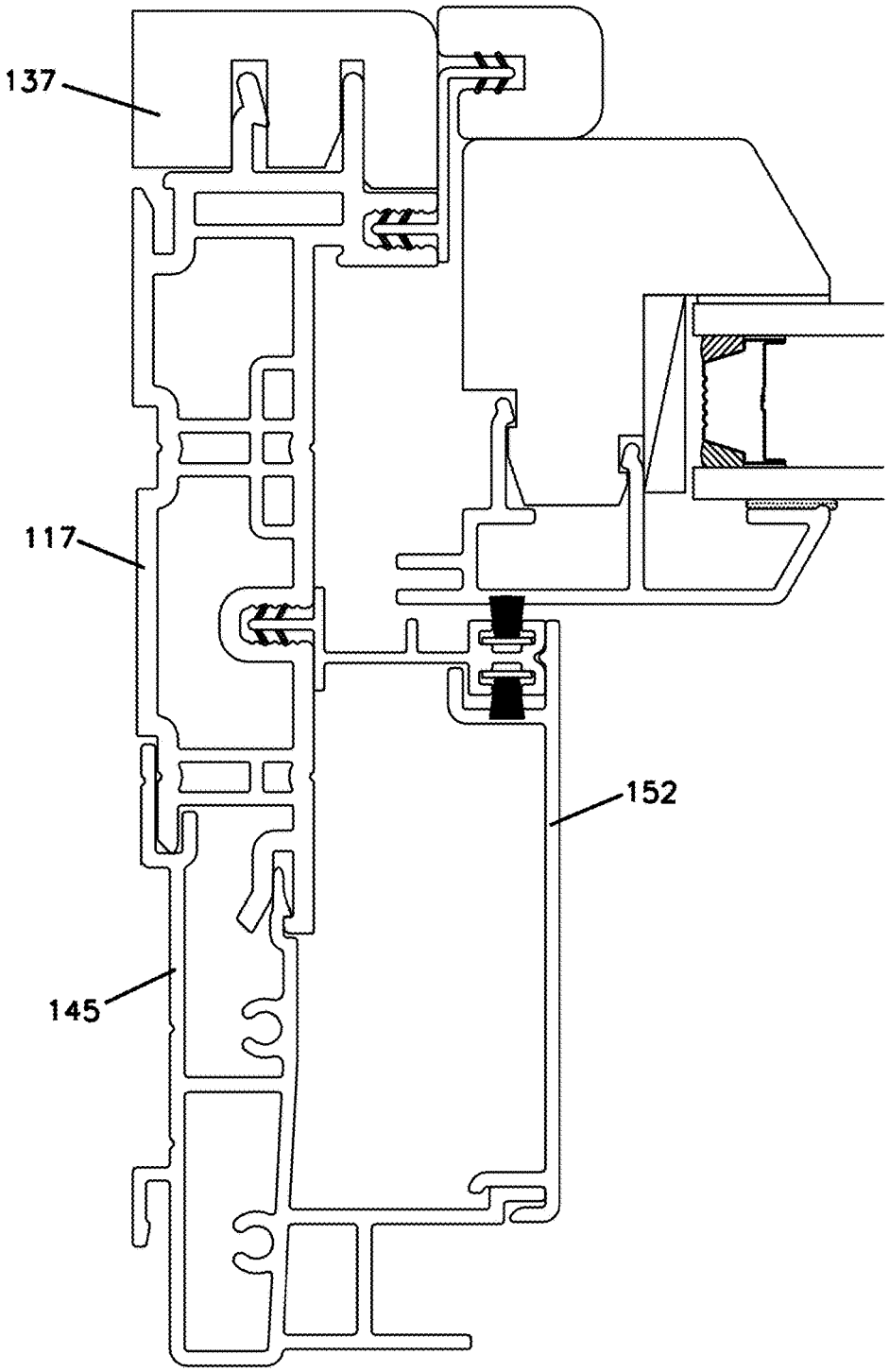
FIG. 38 is a cross-sectional view of a portion of an exemplary window assembly including the base frame member of FIG. 3 and selected components shown in FIGS. 7 to 26.

FIG. 38 shows a configuration where the base frame member 117, the trim piece 137, the cladding member 145, and the interior assembly 152 have been assembled together to form a jamb for an insert window.

Figure 39:
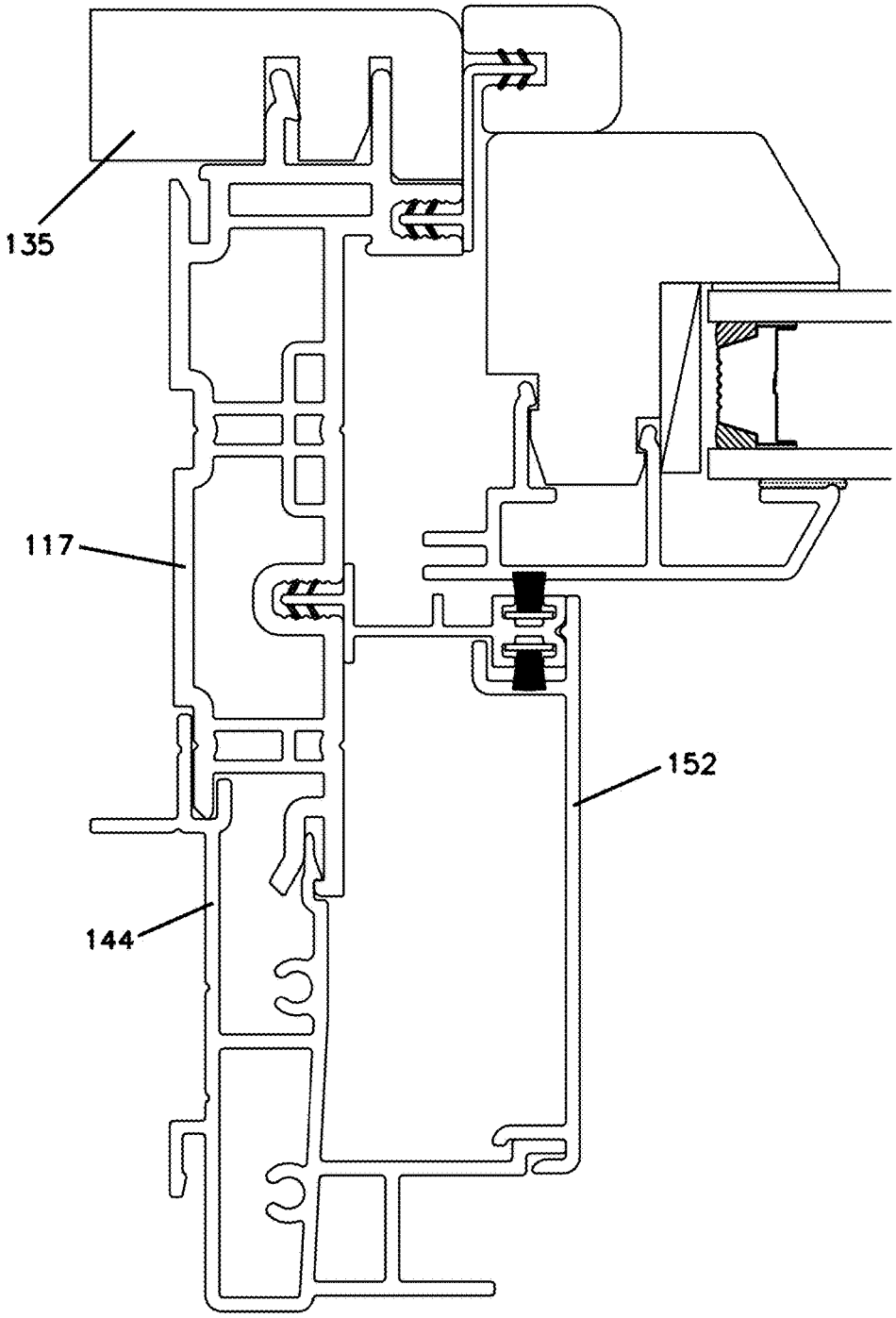
FIG. 39 is a cross-sectional view of a portion of an exemplary window assembly including the base frame member of FIG. 3 and selected components shown in FIGS. 7 to 26.

FIG. 39 shows a configuration where the base frame member 117, the trim piece 135, the cladding member 144, and the interior assembly 152 have been assembled together to form a jamb for a pocket window.

Based on the foregoing, numerous variations are possible for forming various window frame assemblies. Although a number of examples are presented herein, many more are possible without departing from the concepts presented herein.

With regard to the foregoing description, it is to be understood that changes may be made in detail, especially in matters of the construction materials employed and the shape, size and arrangement of the parts without departing from the scope of the present disclosure. It is intended that the specification and depicted aspects be considered exemplary only, with a true scope and spirit of the invention being indicated by the broad meaning of the following claims.

I claim:

1. A window assembly comprising:

a. a base frame assembly supporting at least one window pane and being configured for insertion into an opening in a wall, the base frame assembly being formed from extruded segments defining a main body having an interior-side surface and an opposite opening-side surface extending between first and second ends, wherein the interior-side surface is parallel to the opening-side surface;

b. an interior assembly attached to a first one of the extruded segments of the base frame assembly to form a sloped sill;

c. a cladding member attached to the first extruded segment, the cladding member defining a plurality of water drainage apertures;

d. wherein the base frame assembly, the interior assembly, and the cladding member defining an interior drainage path extending from the water drainage apertures to an interstitial space defined between the interior assembly and the base frame first extruded segment;

e. wherein the base frame extruded segments include: a first attachment arrangement located proximate the main body first end, the first attachment arrangement being attached to the cladding member, wherein the first attachment arrangement includes a first clip member having a first outer portion and a first inner portion that define a first female receiving area and having a first overhang portion extending at least partially across the female receiving area to enable a snap-fit connection between the main body and the cladding member.

2. The window assembly of claim 1, wherein the first attachment arrangement includes a ramped portion connected to the inner portion of the first clip member, the ramped portion extending at an oblique angle to the first clip member inner portion.

3. The window assembly of claim 1, wherein the first overhang portion extends from a distal end of the first outer portion.

4. The window assembly of claim 1, wherein the first attachment arrangement further includes a second clip member having a second outer portion and a second inner portion that define a second female receiving area and having a second overhang portion extending at least partially across the female receiving area to enable a snap-fit connection between the main body and the cladding member.

5. The window assembly of claim 4, further including a ramped portion extending between the first and second inner portions of the first attachment arrangement.

6. The window assembly of claim 4, wherein the second overhang portion extends from a distal end of the second outer portion.

7. A window assembly comprising:

a. a base frame assembly supporting at least one window pane and being configured for insertion into an opening in a wall, the base frame assembly including at least a sill member formed from an extruded segment defining a main body having an interior-side surface facing towards a head member of the base frame assembly and having an opposite opening-side surface extending between first and second ends, the interior-side and opening-side surfaces defining a hollow cavity therebetween, wherein the interior-side surface is parallel to the opening-side surface;

b. an interior assembly attached to the extruded segment to form a sloped sill;

c. a cladding member attached to the extruded segment, the cladding member defining a plurality of water drainage apertures;

d. wherein the extruded segment, the interior assembly, and the cladding member defining an interior drainage path extending from the water drainage apertures to an interstitial space defined between the interior assembly and the base frame assembly extruded segment;

e. wherein the base frame extruded segment includes:

i. a first attachment arrangement located proximate the main body first end, the first attachment arrangement being attached to the cladding member;

ii. a second attachment arrangement located proximate the main body second end, the second attachment arrangement being configured for attachment to one or more trim members; and iii. a third attachment arrangement located at or between the first and second ends, the third attachment arrangement being configured for attachment to one or more interior members of the interior assembly.

8. The window assembly of claim 7, wherein the first attachment arrangement includes a first clip member having a first outer portion and a first inner portion that define a first female receiving area and having a first overhang portion extending at least partially across the female receiving area to enable a snap-fit connection between the main body and the cladding member.

9. The window assembly of claim 8, wherein the first attachment arrangement includes a ramped portion connected to the inner portion of the first clip member, the ramped portion extending at an oblique angle to the first clip member inner portion.

10. The window assembly of claim 8, wherein the first overhang portion extends from a distal end of the first outer portion.

11. The window assembly of claim 8, wherein the first attachment arrangement further includes a second clip member having a second outer portion and a second inner portion that define a second female receiving area and having a second overhang portion extending at least partially across the female receiving area to enable a snap-fit connection between the main body and the cladding member.

12. The window assembly of claim 11, further including a ramped portion extending between the first and second inner portions of the first attachment arrangement.

13. The window assembly of claim 11, wherein the second overhang portion extends from a distal end of the second outer portion.

14. The window assembly of claim 7, wherein the cladding member is attached to the interior assembly.

15. The window assembly of claim 7, wherein the water drainage apertures are located at a nose portion of the cladding member.

16. The window assembly of claim 7, wherein the interior assembly forming the sloped sill includes a first part connected to the base frame member and a second part connected to the first part and connected to the cladding member.

17. The window assembly of claim 7, wherein the cladding member is attached to the first end of the first extruded segment.

18. The window assembly of claim 7, wherein the cladding member is attached to the interior assembly.

* * * * *